US006375312B1

(12) United States Patent
Ikeda et al.

(10) Patent No.: US 6,375,312 B1
(45) **Date of Patent: *Apr. 23, 2002**

(54) HEAT GENERATING RESISTOR CONTAINING $TAN_{0.8}$, SUBSTRATE PROVIDED WITH SAID HEAT GENERATING RESISTOR FOR LIQUID JET HEAD, LIQUID JET HEAD PROVIDED WITH SAID SUBSTRATE, AND LIQUID JET APPARATUS PROVIDED WITH SAID LIQUID JET HEAD

(75) Inventors: Masami Ikeda, Yokohama; Hiroshi Sugitani, Machida; Shigeyuki Matsumoto, Atsugi; Yasuhiro Naruse, Kiyokawa; Kenji Makino, Yokohama; Masaaki Izumida, Kawasaki; Seiichi Tamura, Atsugi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/819,366

(22) Filed: Mar. 17, 1997

Related U.S. Application Data

(63) Continuation of application No. 08/266,685, filed on Jun. 28, 1994, now abandoned.

(30) Foreign Application Priority Data

Jun. 28, 1993 (JP) ..... 5-157588
Sep. 8, 1993 (JP) ..... 5-223545

(51) Int. Cl.[7] ..... B41J 2/05

(52) U.S. Cl. ..... 347/62

(58) Field of Search ..... 347/62; 219/543; 338/308, 314; 423/409

(56) References Cited

U.S. PATENT DOCUMENTS 3,242,006 A 3/1966 Gerstenberg ..... 117/201

(List continued on next page.)

FOREIGN PATENT DOCUMENTS

| | | |
|---|---|---|
| DE | 2843064 | 4/1979 |
| GB | 1249951 | * 11/1969 |
| JP | 54 59936 | 5/1979 |
| JP | 55 27281 | 2/1980 |

OTHER PUBLICATIONS

Structural Correlation in tantalum Nitride Formation by Direct Nitrogen Implantation, X Xhou, H K Dong, H D Li and B X Liu, 1989.*

(List continued on next page.)

*Primary Examiner*—John Barlow
*Assistant Examiner*—Michael S Brooke
(74) *Attorney, Agent, or Firm*—Fitzpatrick, Cella, Harper & Scinto.

(57) ABSTRACT

A heat generating resistor comprised of a film composed of a $TaN_{0.8}$-containing tantalum nitride material which is hardly deteriorated and is hardly varied in terms of the resistance value even upon continuous application of a relatively large quantity of an electric power thereto over a long period of time. A substrate for a liquid jet head comprising a support member and an electrothermal converting body disposed above said support member, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, characterized in that said heat generating resistor layer comprises a film composed of a $TaN_{0.8}$-containing tantalum nitride material. A liquid jet head provided with said substrate for a liquid jet head. A liquid jet apparatus provided with said liquid jet head.

15 Claims, 12 Drawing Sheets

U.S. PATENT DOCUMENTS 3,878,099 A * 4/1975 Schauer ..... 204/192
4,368,476 A 1/1983 Uehara et al.
4,535,343 A 8/1985 Wright et al.
4,626,875 A * 12/1986 Hara et al. ..... 347/62
4,663,640 A 5/1987 Ikeda
4,737,709 A 4/1988 Loftus ..... 324/208
4,849,774 A 7/1989 Endo et al.
5,187,497 A 2/1993 Hirano et al.
5,221,449 A * 6/1993 Colgan et al. ..... 204/192.15
5,245,362 A 9/1993 Iwata et al.
5,281,485 A * 1/1994 Colgan et al. ..... 428/457
5,484,075 A * 1/1996 Kimura et al. ..... 216/27

OTHER PUBLICATIONS

Matsumoto, et al.; "Formation of Cubic tantalum Nitride by Heating Hexagonal Tantalum Nitride in a Nitrogen–Argon Plasma Jet", Journal of the Less Common Metals vol. 60, (1978); pp 147–149.*

N. Terao, "Structure of Tantalum Nitrides," Japanese Journal of Applied Physics, vol. 10, No. 2, (Feb., 1971), pp. 248–259.

* cited by examiner

HEAT GENERATING RESISTOR CONTAINING $TAN_{0.8}$, SUBSTRATE PROVIDED WITH SAID HEAT GENERATING RESISTOR FOR LIQUID JET HEAD, LIQUID JET HEAD PROVIDED WITH SAID SUBSTRATE, AND LIQUID JET APPARATUS PROVIDED WITH SAID LIQUID JET HEAD

This application is a continuation of application Ser. No. 08/266,685, filed Jun. 28, 1994, now abandoned.

BACKGROUND OF THE INVENTION

1. Field of the invention

The present invention relates to an improved heat generating resistor comprising a specific tantalum nitride containing $TaN_{0.8}$ which excels not only in terms of heat generation performance but also in terms of durability upon repeated use and which can be produced at a reduced production cost. The heat generating resistor is applicable to various outputting mechanism-bearing devices or systems such as printers, facsimiles, copying machines, and composite mechanized retrieval systems, and also to their terminal printers of printing an object outputted on a printing medium. Particularly, the heat generating resistor is suitable for use particularly in a liquid jet system of discharging and flying printing liquid utilizing a thermal energy to thereby print an image on a medium such as ordinary paper, synthetic paper, fabric, or the like. The present invention includes an improved substrate provided with said heat generating resistor for a liquid jet head, a liquid jet head provided with said substrate, and a liquid jet apparatus provided with said liquid jet head. The present invention enables to produce any of said substrate, liquid jet head, and liquid jet apparatus respectively at an improved precision and at a reduced production cost.

2. Related Background Art

U.S. Pat. No. 3,242,006 (hereinafter referred to as Literature 1) discloses a tantalum nitride (TaN) film resistor (hereinafter referred to as TaN film resistor) formed by impressing a DC voltage of 5000 V between a cathode composed of Ta and an anode in a gaseous atmosphere comprising $N_2$ gas and Ar gas under conditions of 400° C. for the atmospheric temperature, 400° C. for the substrate temperature, and $1\times10^{-4}$ mmHg for the partial pressure of the $N_2$ gas to sputter the Ta cathode. Literature 1 describes that the TaN film is of a sodium chloride type structure rather than the anticipated hexagonal type structure. Further, Literature 1 describes production of $Ta_2N$ of hexagonal structure (hereinafter referred to as $Ta_2N_{hex}$) and mixtures of the $Ta_2N_{hex}$ and TaN of a cubic structure. Hence, it is understood that Literature 1 discloses a resistor comprising a film composed of a tantalum nitride substantially comprised of TaN only (seemingly contaminated with foreign matters) (this tantalum nitride material will be occasionally called TaN single body in the following), a tantalum nitride material substantially comprised of $Ta_2N$ only (seemingly contaminated with foreign matters) (this tantalum nitride material will be occasionally called $Ta_2N$ single body in the following), or a tantalum nitride material comprised of a mixture of these.

Now, there are known a variety of printing systems of discharging and flying ink utilizing a thermal energy to form an ink droplet whereby printing an image on a printing medium. Of those printing systems, the so-called on-demand type ink jet printing system has been evaluated as being the most appropriate because the noise cased upon conducting printing can be reduced to a negligible order.

U.S. Pat. No. 4,849,774 (or German Patent No. 2843064) (hereinafter referred to as Literature 2) discloses a on-demand type bubble jet printing system which attains on-demand printing by causing film boiling for ink to discharge ink in the form of an ink droplet whereby printing an image on a printing medium. Literature 2 describes the use of a heat generating resistor composed of a metal boride (specifically, $HfB_2$) or tantalum nitride. The tantalum nitride described in Literature 2 is apparent to include the TaN single body, $Ta_2N_{hex}$ single body, and mixtures of these described in Literature 1 in view of the priority dated of Literature 2 in relation to the publication date of Literature 1.

Now, it is understood that the heat generating resistor comprising $HfB_2$ or tantalum nitride is compatible with the film-boiling phenomenon and satisfies the requirements relating to ink discharging characteristics, printing speed, and printing condition as far as the bubble jet printing system described in Literature 2 is concerned.

However, in on-demand type bubble jet printing systems provided with an markedly increased number of discharging outlets which have been developed in recent years after (specifically, after 1983) or will be developed in the future, it is commonly recognized that not the heat generating resistor composed of tantalum nitride but only a heat generating resistor composed of $HfB_2$ or TaAl satisfies the conditions required for such markedly increased discharging outlets in terms of stability and durability.

Incidentally, there are a number of reports on thermal heads having a heat generating resistor composed of tantalum nitride in which the heat generating resistor is directly contacted with a heat-sensitive paper or an ink ribbon. The heat generating resistor herein is understood to be similar to that described in Literature 1.

Other than this, U.S. Pat. No. 4,737,709 (hereinafter referred to as Literature 3) discloses a thermal head having a heat generating resistor comprising a film of tantalum nitride ($Ta_2N$) having a hexagonal close-packed lattice oriented in (101) direction which is formed by the reactive sputtering process. It is understood that Literature 3 is directed to an improvement in the thermal head in terms of the durability by using said specific tantalum nitride film as the heat generating resistor.

It should be noted to the fact that any of the tantalum nitrides films described in these documents has never been actually used as a heat generating resistor of an ink jet head, although they have been used in a thermal head.

Description will be made of the reason for this. That is, in the case of a thermal head, the electric power applied to the heat generating resistor is about 1 W for a period of 1 $\mu$sec. On the other hand, in the case of an ink jet head, in order to conduct film-boiling of ink for a very short period of time, an electric power of a wattage in the range of from 3 W to 4 W is applied to the heat generating resistor, for instance, for a period of 7 $\mu$sec. It is understood that the electric power applied to the heat generating resistor for such a short period of time in the case of the ink jet head is greater as much as several times the electric power applied to the heat generating resistor for a relatively longer period of time in the case of the thermal head.

In order to examine whether or not the foregoing conventional tantalum film resistors are practically usable as the heat generating resistor for an ink jet head, the present inventors prepared a plurality of ink jet heads each having a heat generating resistor composed of any of the foregoing conventional tantalum nitride films, and subjecting each of the ink jet heads to printing. As a result, there was obtained a finding in that there is a tendency for any of the heat generating resistors to be greatly varied in terms of the resistance value within a short period of time upon the application of a large quantity of an electric power thereto. Such variation in terms of the resistance value for the heat generation resistor is not serious in the case of a thermal head since it is not instantly influenced to an image obtained. However, in the case of an ink jet head, a serious problem entails in that generation of a bubble at ink is not stably occurred as desired to cause a decrease in the quantity of an ink droplet discharged, resulting in making an image printed to be inferior in terms in the quality.

Hence, the reason why any of the conventional tantalum nitride heat generating resistors described in the above documents has never been practically used in an ink jet head can be understood. In fact, there cannot be found any report in which the use of a tantalum nitride heat generating resistor in an ink jet head has been studied. And, in the ink jet heads in recent years, a heat generating resistor composed of $HfB_2$ has been actually often used as their heat generating resistor.

Other than the above-described U.S. patent documents, there can be found U.S. Pat. No. 4,535,343 (hereinafter referred to as Literature 4), Japanese Unexamined-Patent Publication No. 59936/1979 (hereinafter referred to as Literature 5), and Japanese Unexamined Patent Publication No. 27281/1980 (hereinafter referred to as Literature 6) which disclose tantalum nitride films. Particularly, Literature 4 discloses a thermal ink jet printhead having a heat generating resistor layer comprising a tantalum nitride ($Ta_2N$) film formed by means of the RF or DC diode sputtering process wherein a Ta-target is sputtered in an atmosphere comprising a gaseous mixture of Ar gas and $N_2$ gas with a volumetric ratio of 10:1.

However, in an ink jet head provided with an markedly increased number of discharging outlets which have been developed in recent years, the heat generating resistor composed of tantalum nitride described in Literature 4 does not satisfy the conditions required for such markedly increased discharging outlets in terms of stability and durability for the same reason above described.

Literatures 5 and 6 disclose an ink jet recording head having a heat generating resistor composed of tantalum nitride (specifically, $Ta_2N$ single body) formed by the vacuum evaporation or sputtering process.

Any of the tantalum nitrides by which the heat generating resistors are constituted described in these Literatures 5 and 6 is one that has a so-called $Ta_2N_{hexagonal}$ structure (that is, $Ta_2N_{hex}$). Any of these heat generating resistors composed of the $Ta_2N_{hex}$ single body is also problematic in that there is a tendency for the heat generating resistor to be greatly varied in terms of the resistance value to cause a decrease in the quantity of an ink droplet discharged, resulting in making an image printed to be inferior in terms in the quality, when recording is continuously conducted while discharging ink over a long period of time. Because of this, the $Ta_2N_{hex}$ single body is not practically usable as the constituent for a heat generating resistor in an ink jet head provided with an markedly increased number of discharging outlets for the same reason above described. In fact, there cannot be found any report in which the use of such $Ta_2N_{hex}$ single body as the heat generating resistor in an ink jet head has been discussed.

SUMMARY OF THE INVENTION

As above described, $HfB_2$ has been evaluated as being suitable as the constituent of a heat generating resistor for use in an ink jet head since a heat generating resistor composed of $HfB_2$ mostly meets the requirements for the heat generating resistor in an ink jet head, and the heat generating resistor composed of $HfB_2$ has been often used in ink jet heads.

However, there is a fear for $HfB_2$ as the constituent material of the heat generating resistor used in an ink jet head to be possibly in short supply. That is, only one or two companies are concerned with the production of $HfB_2$ in the world. Therefore, stable supply of $HfB_2$ is not always secured. In addition, Hf as the starting material in the production of $HfB_2$ is a by-product obtained upon producing an atomic fuel. Thus, there is a fear that the production of $HfB_2$ will be possibly terminated as a result of worldwide discussions for the environmental problems possibly caused upon producing the atomic fuel.

In addition to these problems, for the heat generating resistor composed of $HfB_2$ used in ink jet heads, there are other problems such as will be described below.

Firstly, there is a new demand for the performance of the heat generation resistor used in an ink jet head. That is, in recent years, it has been discussed that as long as the heat generating resistor of an ink jet head is controllable in terms of the quantity of ink discharged, double pulsation for a pulse applied to the heat generating resistor is more effective in order to conduct color-printing by the ink jet head. In order to make it possible to conduct the double pulsation for a pulse applied to the heat generating resistor, the heat generating resistor is required to be markedly high particularly in terms of the durability. However, the heat generating resistor composed of $HfB_2$ does not sufficiently meets this requirement.

Secondly, there is a problem in view of the production of a heat generating resistor composed of $HfB_2$. That is, since a $HfB_2$ film as the heat generating resistor is formed by means of the RF sputtering manner, the resulting $HfB_2$ films are unavoidably varied in terms of their quality. Particularly, a Hf material used as the target is often accompanied by certain foreign matters and those foreign matters are liable to contaminate into a $HfB_2$ film formed.

Incidentally, it is recognized that the foreign matters contained in the $HfB_2$ film are liable to impart negative influences to semiconductor elements such as metal-oxide-semiconductors. In addition, such $HfB_2$ film contaminated with the foreign matters is not sufficient in terms of compatibility with such semiconductor element when produced using the $HfB_2$ film.

In recent years, there have been developed a substrate for an ink jet head integrally provided with a signal-input logic circuit and a Bi-CMOS integrated circuit constituting a heater driver. When the above $HfB_2$ film contaminated with foreign matters is used as the heat generating resistor in this substrate for producing an ink jet head, the aforesaid poor compatibility of the $HfB_2$ film with the semiconductor elements entails a serious problem in that the resulting ink jet head unavoidably becomes insufficient in terms of the quality.

The present inventors made extensive studies through experiments in order to eliminate the foregoing problems in the case of using $HfB_2$ as the heat generating resistor in an ink jet head. Particularly, the present inventors made experimental studies aiming at finding out a relevant material suitable as the constituent for the heat generating resistor for an ink jet head, which is free of such a drawback as in the case of $HfB_2$ in terms of the stable supply and which can be easily produced by a relatively simple film-forming process, while focusing on tantalum nitride materials which once had been deemed as being not suitable as the constituent material of the heat generating resistor in an ink jet head.

In the experimental studies, the present inventors prepared a plurality of heat generating resistors each comprising a tantalum nitride material selected from the group consisting the foregoing TaN single body, $Ta_2N$ single body, and mixtures of these described in the foregoing prior art, and prepared a plurality of ink jet head provided with an increased number of discharging outlets using these heat generating resistors. And each of the resultant ink jet heads obtained was subjected to printing continuously over a long period of time in a manner of applying a pre-pulse and then applying a main pulse at a given interval for discharging ink (this manner will be hereinafter referred to as double pulsating manner). As a result, no satisfactory printing could be conducted in any case. And it was found that any of the heat generating resistors does not perform so as to meet the requirements desired therefor.

And further experimental studies by the present inventors resulted in finding a new tantalum nitride material containing $TaN_{0.8}$ (hereinafter referred to as $TaN_{0.8}$-containing tantalum nitride material) which is clearly distinguished from any of the foregoing conventional TaN single body, $Ta_2N$ single body, and mixtures of these and which makes it possible to obtain a desirable heat generating resistor which is hardly varied in terms of the resistant value even upon continuously applying a relatively large quantity of electric power thereto over a long period of time and which enables to provide a highly reliable ink jet head which stably and continuously exhibits printing performance in a desirable state even when printing is carried out by driving the ink jet head in the double pulsating manner.

The present invention has been accomplished on this finding.

Hence, the principal object of the present invention is to eliminate the foregoing problems in relation to the conventional heat generating resistor for a liquid jet head and to provide an improved heat generating resistor comprised of a specific $TaN_{0.8}$-containing tantalum nitride material which is hardly varied in terms of the resistant value even upon continuously applying a relatively large quantity of electric power thereto over a long period of time and which enables to obtain a highly reliable liquid jet head which stably and continuously exhibits excellent ink discharging performance to provide high quality prints even upon repeated use over a long period of time.

Another object of the present invention is to provide a substrate for a liquid jet head which is provided with an improved heat generating resistor comprised of a specific $TaN_{0.8}$-containing tantalum nitride material, a liquid jet head provided with said substrate, and a liquid jet apparatus provided with said liquid jet head.

A further object of the present invention is to provide an improved heat generating resistor comprised of a specific $TaN_{0.8}$-containing tantalum nitride material which enables to obtain a highly reliable liquid jet head which stably and continuously exhibits excellent liquid discharging performance to provide high quality prints even when printing is carried out repeatedly over a long period of time by driving the liquid jet heat in the double pulsating manner, a substrate for a liquid jet head provided with said improved heat generating resistor, a liquid jet head provided with said substrate, and a liquid jet apparatus provided with said liquid jet head.

A further object of the present invention is to provide an improved heat generating resistor comprised of a specific $TaN_{0.8}$-containing tantalum nitride material which enables to obtain a highly reliable liquid jet head provided with an increased number of discharging outlets which stably and continuously exhibits excellent liquid discharging performance to provide high quality prints even when printing is carried out repeatedly over a long period of time by driving the liquid jet head in the double pulsating manner, a substrate for a liquid jet head provided with said improved heat generating resistor, a liquid jet head provided with an increased number of discharging outlets and which is provided with said substrate, and a liquid jet apparatus provided with said liquid jet head.

A further object of the present invention is to provide an improved heat generating resistor comprised of a specific $TaN_{0.8}$-containing tantalum nitride material having an excellent compatibility with semiconductor elements such as input-signal logic circuit, Bi-CMOS integrated circuit, and the like disposed in a substrate for a liquid jet head, a substrate provided with said semiconductor elements for a liquid jet head and which is provided with said improved heat generating resistor, a liquid jet head provided with said substrate, and a liquid jet apparatus provided with said liquid jet head.

A further object of the present invention is to provide an improved heat generating resistor having a stacked structure with a layer comprised of a specific $TaN_{0.8}$-containing tantalum nitride material as one of the constituent layers which is hardly varied in terms of the resistant value even upon continuously applying a relatively large quantity of electric power thereto over a long period of time and which enables to obtain a highly reliable liquid jet head which stably and continuously exhibits excellent liquid discharging performance to provide high quality prints even upon repeated use over a long period of time, a substrate for a liquid jet head which is provided with said improved heat generating resistor, a liquid jet head provided with said substrate, and a liquid jet apparatus provided with said liquid jet head.

DETAILED DESCRIPTION OF THE INVENTION AND THE PREFERRED EMBODIMENTS

Figure 1:
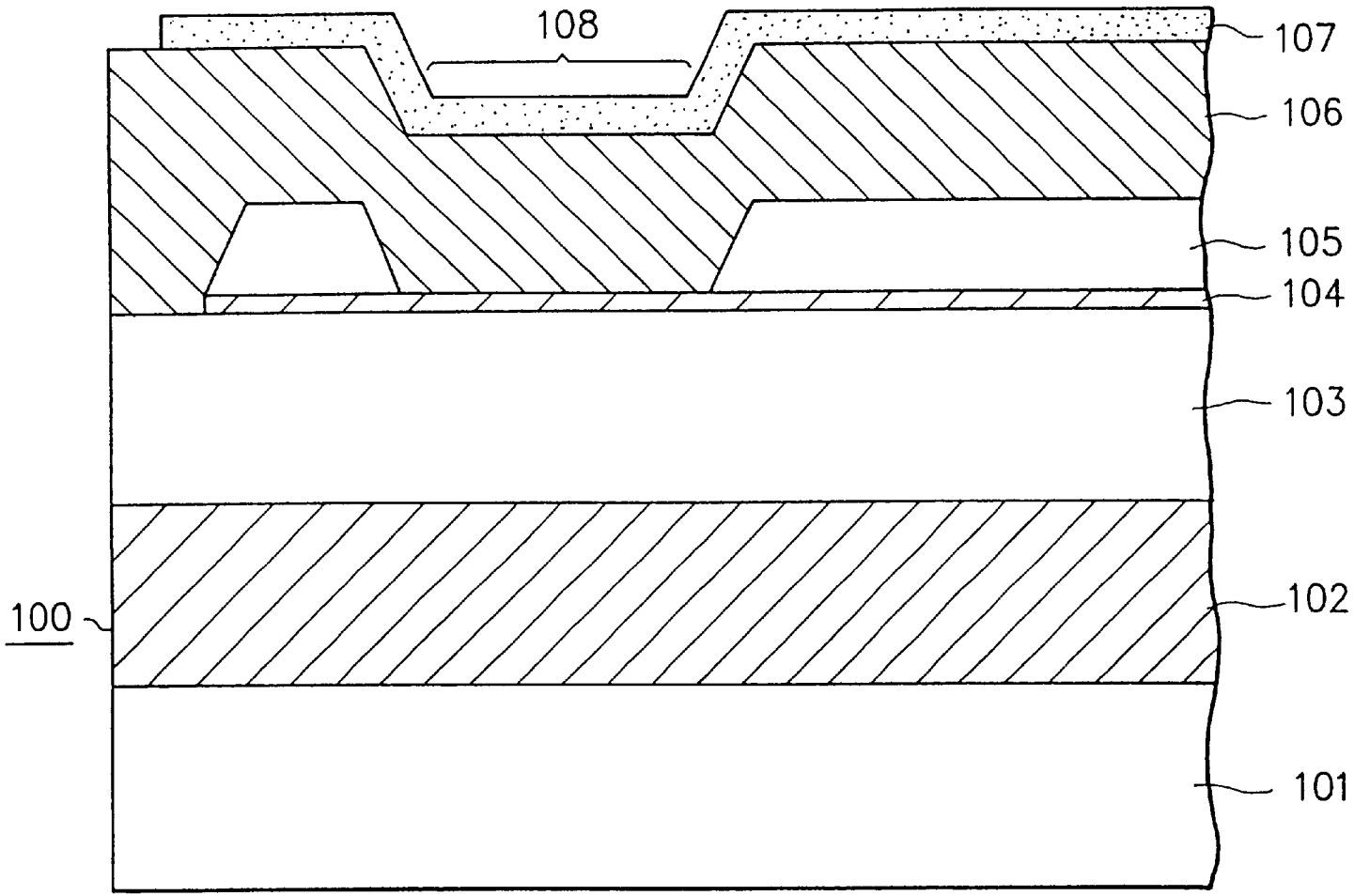
FIG. 1 is a schematic cross-sectional view of the principal part of an example of a substrate for a liquid jet head according to the present invention.

The present invention includes an improved heat generating resistor, a substrate for a liquid jet head which is provided with said improved heat generating resistor, a liquid jet head provided with said substrate, and a liquid jet apparatus provided with said liquid jet head.

A typical heat generating resistor according to the present invention is comprised of a film composed of a $TaN_{0.8}$-containing tantalum nitride material and which is hardly deteriorated and is hardly varied in terms of the resistance value even upon continuous application of a relatively large quantity of an electric power thereto over a long period of time. The $TaN_{0.8}$-containing tantalum nitride material can include tantalum nitride materials containing $TaN_{0.8}$ in an amount of 17 mol. % to 100 mol. % or preferably, in an amount of 20 mol. % to 100 mol. %, a tantalum nitride material substantially comprising $TaN_{0.8}$ only, and tantalum nitride materials containing $TaN_{0.8}$, and $Ta_2N$ or TaN. Specific examples of the $TaN_{0.8}$ and $Ta_2N$-containing tantalum nitride material are tantalum nitride materials containing $Ta_2N$ and $TaN_{0.8}$ in an amount of more than 17 mol. % or preferably, in an amount of more than 50 mol. %. Specific examples of the $TaN_{0.8}$ and TaN-containing tantalum nitride material are tantalum nitride materials containing TaN and $TaN_{0.8}$ in an amount of more than 20 mol. % or preferably, in an amount of more than 50 mol. %. In a most preferred embodiment, the heat generating resistor according to the present invention is comprised of a film composed of a tantalum nitride material substantially comprising $TaN_{0.8}$ only.

Another typical heat generating resistor according to the present invention comprises a multi-layered body having a layer as one of the constituent layer, comprising a film composed any of the above described tantalum nitride materials.

The heat generating resistor according to the present invention desirably is applicable to various outputting mechanism-bearing devices or systems such as printers as disclosed, for example, in U.S. Pat. No. 5,187,497, or U.S. Pat. No. 5,245,362, facsimiles, copying machines, and composite mechanized retrieval systems, and also to their terminal printers of printing an object outputted on a printing medium.

Particularly, the heat generating resistor according to the present invention is most suitable for use as a heat generating resistor in a liquid jet system of discharging and flying printing liquid utilizing a thermal energy to thereby print an image on a medium such as ordinary paper, synthetic paper, fabric, or the like. In this case, the liquid jet system is such that the heat generating resistor thereof can be operated at a voltage in the range of from a voltage corresponding to a value which is 1.1 holds over the lowest $V_{th}$ at which printing liquid (ink) can be discharged to a voltage corresponding to a value which is 1.4 holds over said $V_{th}$. Further, the liquid jet system can be operated at a driving frequency of 10 kHz or above. In any case, there is continuously provided a high quality printed image over a long period of time without the heat generating resistor being deteriorated.

The present invention provides an improved substrate for a liquid jet head.

A typical embodiment of the substrate for a liquid jet head according to the present invention comprises a support member and an electrothermal converting body disposed above said support member, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, characterized in that said heat generating resistor layer comprises a film composed of a $TaN_{0.8}$-containing tantalum nitride material. The $TaN_{0.8}$-containing tantalum nitride material herein can include tantalum nitride materials containing $TaN_{0.8}$ in an amount of 17 mol. % to 100 mol. % or preferably, in an amount of 20 mol. % to 100 mol. %, a tantalum nitride material substantially comprising $TaN_{0.8}$ only, and tantalum nitride materials containing $TaN_{0.8}$, and $Ta_2N$ or TaN. Specific examples of the $TaN_{0.8}$ and $Ta_2N$-containing tantalum nitride material are tantalum nitride materials containing $Ta_2N$ and $TaN_{0.8}$ in an amount of more than 17 mol. % or preferably, in an amount of more than 50 mol. %. Specific examples of the $TaN_{0.8}$ and TaN-containing tantalum nitride material are tantalum nitride materials containing TaN and $TaN_{0.8}$ in an amount of more than 20 mol. % or preferably, in an amount of more than 50 mol. %.

The heat generating resistor layer of the substrate for a liquid jet head may be a multi-layered body having a layer as one of the constituent layer, comprising a film composed any of the above described tantalum nitride materials.

In an alternative, the substrate for a liquid jet head according to the present invention may be of a configuration which comprises a support member comprising a single crystal silicon wafer having a driving circuit formed therein, a heat accumulating layer disposed above said support member, an electrothermal converting body disposed above said heat accumulating layer, a protective layer disposed so as to cover said electrothermal converting body, and a cavitation preventive layer disposed on said protective layer, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, characterized in that said heat generating resistor layer comprises a film composed of a $TaN_{0.8}$-containing tantalum nitride material. The $TaN_{0.8}$-containing tantalum nitride material herein may be any of the above described tantalum nitride materials.

The present invention provides an improved liquid jet head provided with the above described substrate for a liquid jet head.

A typical embodiment of the liquid jet head according to the present invention includes a liquid discharging outlet; a substrate for a liquid jet head, including a support member and an electrothermal converting body disposed above said support member, said electrothermal converting body including a heat generating resistor layer capable of generating a thermal energy for discharging printing liquid (for example, ink) from said discharging outlet and electrodes being electrically connected to said heat generating resistor layer, said electrodes being capable of supplying an electric signal for demanding to generate said thermal energy to said heat generating resistor layer; and a liquid supplying pathway disposed in the vicinity of said electrothermal converting body of said substrate, characterized in that said heat generating resistor layer of said substrate comprises a film composed of a $TaN_{0.8}$-containing tantalum nitride material. The $TaN_{0.8}$-containing tantalum nitride material can include tantalum nitride materials containing $TaN_{0.8}$ in an amount of 17 mol. % to 100 mol. % or preferably, in an amount of 20 mol. % to 100 mol. %, a tantalum nitride material substantially comprising $TaN_{0.8}$ only, and tantalum nitride materials containing $TaN_{0.8}$ and $Ta_2N$ or TaN. Specific examples of the $TaN_{0.8}$ and $Ta_2N$-containing tantalum nitride material are tantalum nitride materials containing $Ta_2N$ and $TaN_{0.8}$ in an amount of more than 17 mol. % or preferably, in an amount of more than 50 mol. %. Specific examples of the $TaN_{0.8}$ and TaN-containing tantalum nitride material are tantalum nitride materials containing $Ta_2N$ and $TaN_{0.8}$ in an amount of more than 20 mol. % or preferably, in an amount of more than 50 mol. %.

The heat generating resistor layer of the substrate in this liquid jet head may be a multi-layered body having a layer as one of the constituent layer, comprising a film composed any of the above described tantalum nitride materials.

The discharging outlet in this liquid jet head may comprises an increased number of discharging outlets spacedly arranged along the entire width of a printing area of a printing medium on which printing is to be conducted. Further, the liquid jet head according to the present invention may be configured into an exchangeable type in which a printing liquid tank is integrally disposed.

In an alternative, the substrate in the liquid jet head may be of a configuration which comprises a support member comprising a single crystal silicon wafer having a driving circuit formed therein, a heat accumulating layer disposed above said support member, an electrothermal converting body disposed above said heat accumulating layer, a protective layer disposed so as to cover said electrothermal converting body, and a cavitation preventive layer disposed on said protective layer, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, characterized in that said heat generating resistor layer comprises a film composed of a $TaN_{0.8}$-containing tantalum nitride material. The $TaN_{0.8}$-containing tantalum nitride material herein may be any of the above described tantalum nitride materials.

The present invention provides an improved liquid jet apparatus.

A typical embodiment of the liquid jet apparatus according to the present invention comprises (a) a liquid jet head including a liquid discharging outlet; a substrate for a liquid jet head, including a support member and an electrothermal converting body disposed above said support member, said electrothermal converting body including a heat generating resistor layer capable of generating a thermal energy for discharging printing liquid (for example, ink) from said discharging outlet and electrodes being electrically connected to said heat generating resistor layer, said electrodes being capable of supplying an electric signal for demanding to generate said thermal energy to said heat generating resistor layer; and a liquid supplying pathway disposed in the vicinity of said electrothermal converting body of said substrate, and (b) an electric signal supplying means capable of supplying said electric signal to said heat generating resistor layer of said substrate, characterized in that said heat generating resistor layer of said substrate comprises a film composed of a $TaN_{0.8}$-containing tantalum nitride material. The $TaN_{0.8}$-containing tantalum nitride material can include tantalum nitride materials containing $TaN_{0.8}$ in an amount of 17 mol. % to 100 mol. % or preferably, in an amount of 20 mol. % to 100 mol. %, a tantalum nitride material substantially comprising $TaN_{0.8}$ only, and tantalum nitride materials containing $TaN_{0.8}$, and $Ta_2N$ or TaN. Specific examples of the $TaN_{0.8}$ and $Ta_2N$-containing tantalum nitride material are tantalum nitride materials containing $Ta_2N$ and $TaN_{0.8}$ in an amount of more than 17 mol. % or preferably, in an amount of more than 50 mol. %. Specific examples of the $TaN_{0.8}$ and TaN-containing tantalum nitride material are tantalum nitride materials containing TaN and $TaN_{0.8}$ in an amount of more than 20 mol. % or preferably, in an amount of more than 50 mol. %.

The heat generating resistor layer of the substrate herein may be a multi-layered body having a layer as one of the constituent layer, comprising a film composed any of the above described tantalum nitride materials.

In the liquid jet apparatus, a printing liquid tank may be disposed either at the substrate or at the apparatus main body.

In an alternative, the substrate in the liquid jet apparatus may be of a configuration which comprises a support member comprising a single crystal silicon wafer having a driving circuit formed therein, a heat accumulating layer disposed above said support member, an electrothermal converting body disposed above said heat accumulating layer, a protective layer disposed so as to cover said electrothermal converting body, and a cavitation preventive layer disposed on said protective layer, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, characterized in that said heat generating resistor layer comprises a film composed of a $TaN_{0.8}$-containing tantalum nitride material. The $TaN_{0.8}$-containing tantalum nitride material herein may be any of the above described tantalum nitride materials.

In a further embodiment of the liquid jet apparatus according to the present invention, it is of a configuration in which a plurality of the foregoing liquid jet heads are integrally arranged.

In any of the above described liquid jet head and liquid jet apparatus, the heat generating resistor can be operated at a voltage in the range of from a voltage corresponding to a value which is 1.1 holds over the lowest $V_{th}$ at which printing liquid (ink) can be discharged to a voltage corresponding to a value which is 1.4 holds over said $V_{th}$. Further, they can be operated at a driving frequency of 10 kHz or above. In any case, there is continuously provided a high quality printed image over a long period of time without the heat generating resistor being deteriorated.

Further, in any of the above described liquid jet head and liquid jet apparatus, there can be obtained a desirable printed image using an appropriate printing medium. As such printing medium, there can be mentioned printing mediums having an ink composition comprising 0.5 to 20 wt. % of dye, 10 to 90 wt. % of water-soluble organic solvent such as polyhydric alcohol, polyalkylene glycol, or the like, and 10 to 90 wt. % of water. As a specific example such ink composition, there can be mentioned one comprising 2 to 3 wt. % of C.I. food black, 25 wt. % of diethylene glycol, 20 wt. % of N-methyl-2-pyrrolidone, and 52 wt. % of water.

The present invention provides a process for producing a heat generating resistor comprised of a film composed of a $TaN_{0.8}$-containing tantalum nitride material and which is hardly deteriorated and is hardly varied in terms of the resistance value even upon continuous application of a relatively large quantity of an electric power thereto over a long period of time, said process comprising the steps of: placing a substrate for the formation of said film in a reactive sputtering chamber, forming a gaseous atmosphere of a gaseous mixture comprising nitrogen gas and argon gas, adjusting said nitrogen gas at a partial pressure of 21% to 27%, and applying a DC power of 1.0 to 4.0 kW between a cathode composed of Ta and an anode to sputter said cathode while maintaining said gaseous atmosphere at a temperature of 150 to 230° C. and maintaining said substrate at a temperature of 180 to 230° C., whereby forming said film on said substrate.

Further, the present invention provides a process for producing a substrate for a liquid jet head, comprising a support member and an electrothermal converting body disposed above said support member, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, said heat generating resistor layer being formed of a film composed of a $TaN_{0.8}$-containing tantalum nitride material, characterized in that said film is formed by providing a base member for a substrate for a liquid jet head, placing said base member in a reactive sputtering chamber, forming a gaseous atmosphere of a gaseous mixture comprising nitrogen gas and argon gas, adjusting said nitrogen gas at a partial pressure of 21% to 27%, and applying a DC power of 1.0 to 4.0 kW between a cathode composed of Ta and an anode to sputter said cathode while maintaining said gaseous atmosphere at a temperature of 150 to 230° C. and maintaining said substrate at a temperature of 180 to 230° C., whereby forming said film on said base member.

In the following, description will be made of the experimental studies which were conducted by the present inventors in order to attain the objects of the present invention.

That is, there were prepared a plurality of substrates for a liquid jet head each comprising a support member and an electrothermal converting body disposed above said support member, said electrothermal converting body including a heat generating resistor layer capable of generating a thermal energy and electrodes being electrically connected to said heat generating resistor layer, said electrodes capable of supplying an electric signal for demanding said thermal energy to said heat generating resistor layer, wherein said heat generating resistor layer comprises a film composed of a $TaN_{0.8}$-containing tantalum nitride material formed by the reactive sputtering process in which a Ta-target (purity: 99.99%) as a cathode was sputtered in an atmosphere of a gaseous mixture of argon gas (Ar) and nitrogen gas ($N_2$) with 21 to 27% in partial pressure of the $N_2$ gas and maintained at a given temperature in the range of from 150 to 230° C. by applying a given DC power in the range of from 1.0 to 4.0 kW between the cathode and an anode while maintaining the support member at a given temperature in the range of from 180 to 230° C. Some of the resultant substrates were randomly selected, and their heat generating resistor layers were examined with respect to there reliability upon repeated use while continuously applying a relatively large quantity of an electric power thereto. The results revealed that any of them is hardly deteriorated, is hardly varied in terms of the resistance value, and thus, excels in reliability.

Using these substrates for a liquid jet head, a plurality of liquid jet heads each having an increased number of discharging outlets were prepared. Each of the resultant liquid jet heads was subjected to printing continuously over a long period of time in the double pulsating printing manner in which a pre-pulse is firstly applied and a main pulse as a driving signal for discharging printing liquid (ink) is then applied at a given interval. The results revealed that any of the liquid jet heads always and continuously perform stable ink discharging as desired to provide a high quality printed image over a long period of time, without being deteriorate in terms of the liquid discharging performance.

Separately, there were prepared a plurality of liquid jet heads each comprising a support member having a driving circuit formed therein, a heat accumulating layer disposed above said support member, an electrothermal converting body disposed above said heat accumulating layer, a protective layer disposed so as to cover said electrothermal converting body, and a cavitation preventive layer disposed on said protective layer, said electrothermal converting body including a heat generating resistor layer capable of generating a thermal energy and electrodes being electrically connected to said heat generating resistor layer, said electrodes being capable of supplying an electric signal for demanding to generate said thermal energy to said heat generating resistor layer, wherein said heat generating resistor layer is constituted by a $TaN_{0.8}$-containing tantalum nitride formed by the foregoing film forming manner, and each of the remaining layer is constituted a material containing at least one of the constituent atoms of the heat generating resistor layer, i.e., either tantalum atoms (Ta) or nitrogen atoms (N), specifically, said heat accumulating is constituted by a SiN material or a SiON material, said protective layer by a SiN material or SiON material, and said cavitation preventive layer by a Ta material. The resultant substrates were examined with respect to there reliability upon repeated use while continuously applying a relatively large quantity of an electric power thereto. As a result, there were obtained the following findings. That is, in any of the resultant substrates, the $TaN_{0.8}$ tantalum nitride material functions to make the stacked layers to be tightly adhered with each other, and the advantages of the $TaN_{0.8}$ tantalum nitride material as the heat generating resistor are facilitated in terms of the resistance value and also in terms of the durability.

Using these substrates for a liquid jet head, a plurality of liquid jet heads each having an increased number of discharging outlets were prepared. Each of the resultant liquid jet heads was subjected to printing continuously over a long period of time the double pulsating printing manner. The results revealed that any of the liquid jet heads always and continuously perform stable ink discharging as desired to provide a high quality printed image over a long period of time, without being deteriorated in terms of the liquid discharging performance.

Based on the experimental results obtained, there was obtained the following finding. That is, the use of a specific $TaN_{0.8}$-containing tantalum nitride material, which can be relatively easily formed by a simple film-forming process and which is free of the foregoing problems in the case of using a $HfB_2$ in terms of the contamination of foreign matters and in terms of the supply shortage, as the heat generating resistor layer makes it possible to obtain a highly reliable liquid jet head provided with an increased number of discharging outlets which can perform high speed printing in the double pulsating manner, which is markedly surpassing a liquid jet head in which a $HfB_2$ film is used as the heat generating resistor.

As a results of further experimental studies, there were obtained further findings as will be described below.

A first finding is that the use of a specific $TaN_{0.8}$-containing tantalum nitride material as the heat generating resistor layer make it possible to obtain a highly reliable liquid jet apparatus provided with a multi-layered structure containing, other than the heat generating resistor layer, other functional elements such as a dummy resistor for setting up a given voltage for the discharging heater (the heat generating resistor) and a temperature sensor in which the resistance value of the heat generating resistor layer is monitored and the printing conditions are controlled based on the monitored result and which excels in durability upon repeated use over a long period of time.

A second finding is that in comparison of a liquid jet head having a heat generating resistor formed of a specific $TaN_{0.8}$-containing tantalum nitride material with a liquid jet head having a heat generating resistor formed of a conventional tantalum nitride material (that is, the foregoing TaN single body, $Ta_2N$ single body, or mixture of these), the former is markedly surpassing the latter especially in the case where printing is continuously conducted over a long period of time by way of high frequency driving at a short pulse of 1 $\mu$msec to 10 $\mu$msec, wherein in the former, the heat generating resistor layer is maintained in a stable state without being deteriorated, and a high quality printed image is stably and continuously provided, but in the latter, the heat generating resistor is shortly deteriorated and a high quality printed image is not continuously provided.

A third finding is that a liquid jet head provided with an increased number of discharging outlets and having a heat generating resistor formed of a specific $TaN_{0.8}$-containing tantalum nitride material is hardly deteriorated in terms of the liquid (ink) discharging performance and stably and continuously provides a high quality printed image over a long period of time even in the case where printing is conducted in a manner in which the liquid jet head is driven at a high speed while controlling the state of ink discharged using a plurality of pulses.

On the basis of these findings, the present invention has been accomplished.

The present invention will be described with reference to examples while referring to figures, which are not intended to restrict the scope of the invention.

FIG. 1 is a schematic cross-sectional view of a liquid pathway-forming portion of an example of a substrate for a liquid jet head according to the present invention.

In FIG. 1, reference numeral 100 indicates the entire of a substrate for a liquid jet head, reference numeral 101 a support member comprised of, for example, a single crystal silicon (Si) material, reference numeral 102 a heat accumulating layer comprised of, for example, a thermal silicon oxide material, reference numeral 103 an interlayer film comprising a SiO film or a SiN film which is capable of serving also as a heat accumulating layer, numeral reference 104 a heat generating resistor layer, numeral reference 105 opposite wirings (electrodes comprising common and selective electrodes in other words) each being comprised of a metal such as Al or Cu or an alloy such as Al—Si alloy or Al—Cu alloy, reference numeral 106 a protective layer comprising a SiN film or a SiO film, numeral reference 107 a cavitation preventive layer capable of preventing the protective layer 106 from being damaged by chemical or physical shocks upon heat generation by the heat generating resistor layer 104. As apparent from FIG. 1, the heat generating resistor layer 104 is designed to have a heat generating resistor portion as a functional element situated between the opposite wirings 105. The heat generation resistor layer 104 including said heat generating resistor portion is comprised of the foregoing $TaN_{0.8}$-containing tantalum nitride material.

In the present invention, it is possible to form a plurality of $TaN_{0.8}$-containing tantalum nitride films having an excellent uniformity in terms of the quality. Therefore, even in the case where a number of heat generating resistor portions are disposed in the substrate for a liquid jet head, they stably exhibit their function as a heat generating resistor without being deteriorated and without being varied in terms of the resistance value even in the case where they are energized under various conditions.

Figure 2:
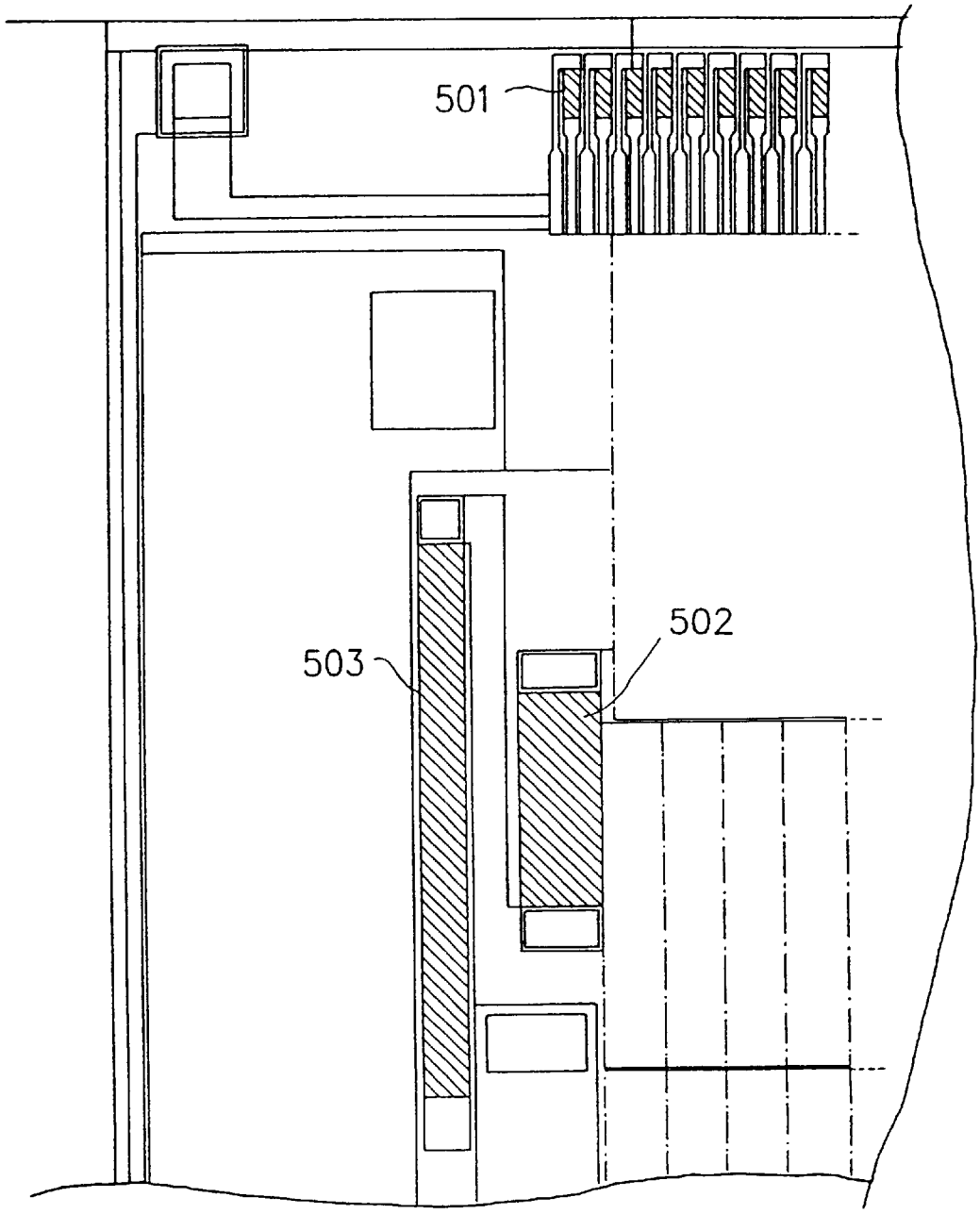
FIG. 2 is a schematic diagram of a layout of a dummy heater for setting $V_{op}$ for a substrate for a liquid jet head according to the present invention.

FIG. 2 is a schematic plan view of the principal part of another example of a substrate for a liquid jet head according to the present invention.

The substrate shown in FIG. 2 is provided with a plurality of heat generating resistors 501 each comprising a film composed of the foregoing $TaN_{0.8}$-containing tantalum nitride material as well as the heat generating resistor layer 104 in the substrate shown in FIG. 1. The substrate shown in FIG. 2 includes a heater 502 which is used for controlling the temperature of the substrate and a resistor portion 503 which is used for examining the resistance value of the heat generating resistor whereby determine the characteristics of a liquid jet head. Each of the heater 502 and resistor portion 503 is comprised of a specific $TaN_{0.8}$-containing tantalum nitride material as well as the heat generating resistors 501. Particularly, as for the resistor portion 503, it is required to always exhibit a desirable resistance in terms of the resistance value in a stable state because in a state that it is disposed in a liquid jet apparatus, it is used for determining conditions for driving a liquid jet head on the apparatus main body and also for controlling the liquid jet head so as to comply with desired conditions for discharging printing liquid (ink). The substrate shown in FIG. 2 includes, other than the above described functional elements, for example, a protective layer, a temperature sensor, and the like.

In the substrate shown in FIG. 2, since each of the heat generating resistor 501, heater 502 and resistor portion 503 is comprised of an identical $TaN_{0.8}$-containing tantalum nitride material, they excel in durability and are hardly varied in terms of the resistance value even upon repeated use under hard driving condition over a long period of time. Thus, the substrate excels in reliability.

Figure 12:
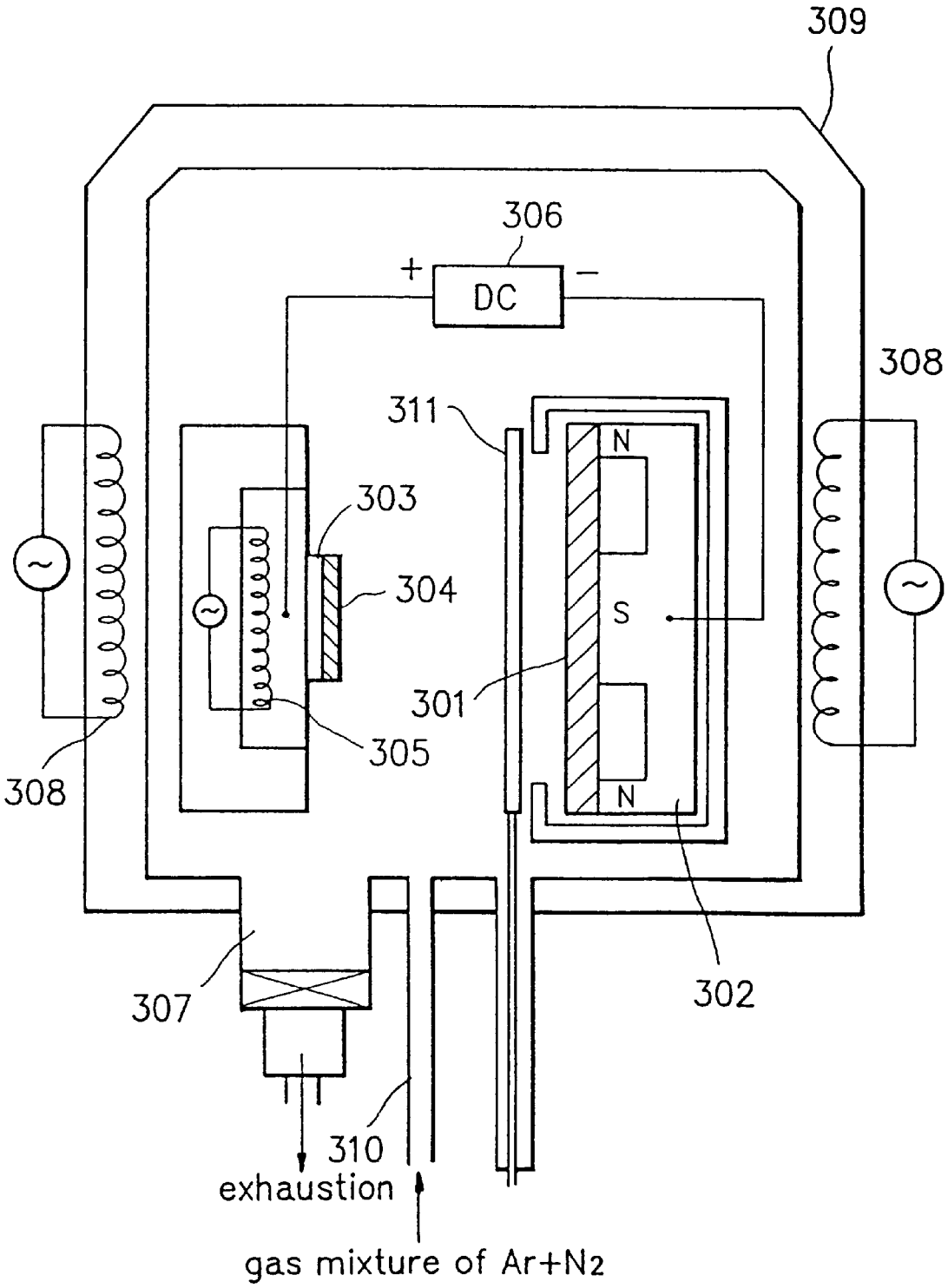
FIG. 12 is a schematic diagram of a film-forming apparatus for forming a constituent layer disposed in a substrate for a liquid jet head in the present invention.

The $TaN_{0.8}$-containing tantalum nitride film constituting each of the heat generating resistor layer 104 in the substrate shown in FIG. 1 and the heat generating resistor 501, heater 502 and resistor portion 505 may be formed by a DC magnetron sputtering process using an appropriate DC magnetron sputtering apparatus having, for example, the constitution shown in FIG. 12.

FIG. 12 is a schematic diagram of the DC magnetron sputtering apparatus comprising a film-forming chamber 309. In FIG. 12, reference numeral 301 indicates a Ta-target of more than 99.99% in purity disposed on a rotatable table having a plane magnet member 302 disposed therein, reference numeral 303 a substrate holder, reference numeral 304 a substrate, reference numeral 305 an electric heater for controlling the temperature of the substrate, reference numeral 306 a DC power source which is electrically connected to the target 301 and to the substrate holder 303, reference numeral 307 an exhaust pipe connected through an exhaust valve to a vacuuming mechanism provided with a cryopump or a turbo-molecular pump, reference numeral 308 an external electric heater which is disposed so as to encircle the exterior of the film-forming chamber 309, and reference numeral 310 a gas feed pipe for introducing Ar gas and $N_2$ gas into the film-forming chamber 309. Reference numeral 311 indicates a shielding member for the target 301. The shielding member 311 is designed such that it can be moved upwards or downwards. The shielding member 311 is lifted so as to shield the target 301 when the target is not used. The external electric heater 308 serves to control the temperature of the inside atmosphere of the film-forming chamber 309. It is desired for the temperature of the substrate 304 upon film formation to be properly controlled using the electric heater 305 and the external electric heater 308 in combination in order to prevent the substrate from being negatively influenced by an thermal energy radiated from the substrate holder 303.

Film formation using the apparatus shown in FIG. 12 is desired to be conducted while rotating the plane magnet 302, wherein high density plasma and γ-electron are desirably distributed on the target 301 side so that the substrate 304 is suffered from neither thermal damage nor physical damage. And upon film formation, it is desired for the inside of the film-forming chamber to be evacuated to a vacuum of $1\times10^{-8}$ to $1\times10^{-9}$ Torr wherein the partial pressure of an impurity gas such as $O_2$ or $H_2$ contained in the film-forming chamber is reduced to a negligible level.

The formation of a tantalum nitride film using the above apparatus is conducted, for example, in the following manner.

That is, firstly, the inside of the film-forming chamber is evacuated to a vacuum of $1\times10^{-8}$ to $1\times10^{9}$ Torr by means of the vacuuming mechanism, wherein the target is shielded by the shielding member 311. Then, a gaseous mixture of Ar gas and $N_2$ gas as a reaction gas is introduced into the film-forming chamber 309 through a mass flow controller (not shown in the figure) capable of controlling the gas flow rate at a 0.1 sccm level and the feed pipe 310. Each of the substrate and the inside atmosphere of the film-forming chamber is maintained at a desired temperature by properly controlling the electric heater 305 and the external electric heater 308. Thereafter, the inside gaseous atmospheres of the film-forming chamber is maintained at a desired pressure by controlling the vacuuming mechanism. Then, the shielding member 311 is moved downwards to expose the target to the inside gaseous atmosphere of the film-forming chamber. Thereafter, the DC power source 306 is switched on to apply a desired DC power between the target and the substrate while rotating the plane magnet, wherein a plasma is caused in the vicinity of the target to sputter the target whereby a $TaN_{0.8}$-containing tantalum nitride film is formed on the substrate.

In accordance with the above described film-forming manner, there were prepared a plurality of different tantalum nitride films under different film-forming conditions. Each tantalum nitride film was formed as a heat generating resistor layer in a substrate for a liquid jet head having the foregoing configuration. And each tantalum nitride film formed was subjected to analysis with respect to its chemical composition and then evaluated with respect to its suitability as the heat generating resistor layer.

That is, firstly, there were provided a plurality of stacked member each comprising a thermal silicon oxide film (as a heat accumulating layer 102) and a SiN film (as a interlayer film 103) stacked on a single crystal silicon wafer, these films having been formed by a conventional film-forming process. The stacked member herein will be hereinafter referred to as substrate 101.

Each substrate 101 was subjected to etching treatment, wherein RF sputtering with a relatively low power of several hundreds wattage incapable of imparting a damage to the substrate was conducted for the surface of the SiN film 103 to etch a some tens angstrom thick surface portion thereof, whereby a clean and even surface was attained for the surface of the substrate.

Each substrate thus treated was positioned on the substrate holder 303 as shown in FIG. 12 (see, 304). The inside of the film-forming chamber 309 was evacuated to a vacuum of $1\times10^{-8}$ Torr through the exhaust pipe 307 by actuating the vacuuming mechanism (not shown in the figure). Then, a gaseous mixture of Ar gas and $N_2$ gas was introduced into the film-forming chamber through the feed pipe 310. The gas pressure in the film-forming chamber was controlled to and maintained at 7.5 mTorr by controlling the vacuuming mechanism.

A different tantalum nitride film was formed on each substrate 102 under conditions of 200° C. for the substrate temperature, 200° C. for the temperature of the gaseous atmosphere in the film-forming chamber, 2.0 kW for the DC power applied, and 7.5 mTorr for the total pressure of the gaseous mixture in the-film-forming chamber while maintaining the partial pressure of the $N_2$ gas at a given value in the range of 10% to 50% in each case.

The resultant tantalum nitride films were subjected to X-ray analysis. As a results, the resultant tantalum nitride films were found to be of one of the three X-ray diffraction patterns, specifically, a X-ray diffraction pattern (I) shown in FIG. 3, a X-ray diffraction pattern (II) shown in FIG. 4, and a X-ray diffraction pattern (III) shown in FIG. 5. In any of these X-ray diffraction patterns, the exponential factor with respect to orientated direction was determined based on ASTM and JCPDS standard data.

Figure 3:
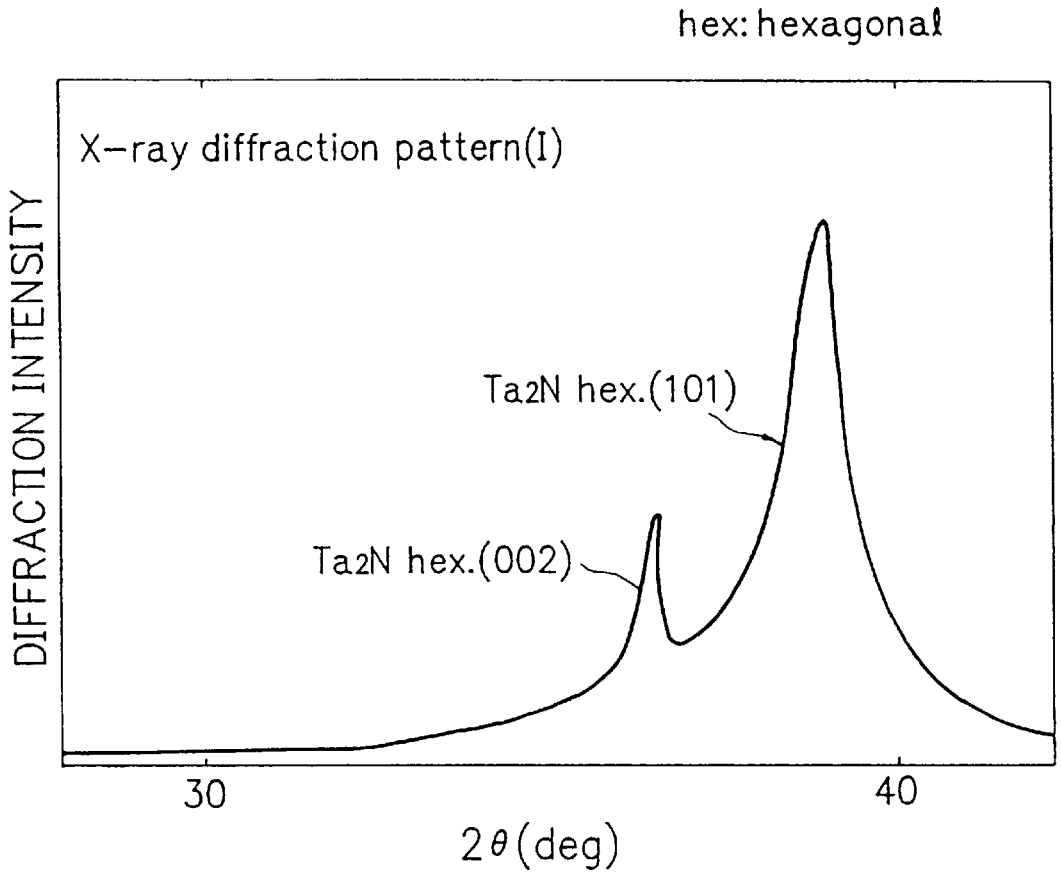
FIG. 3 shows a X-ray diffraction pattern of a conventional resistor layer composed of $Ta_2N_{hex}$.

In the X-ray diffraction pattern (I), as shown in FIG. 3, there were observed a peak corresponding to $Ta_2N_{hex}$ (002) and another peak corresponding to $Ta_2N_{hex}$ (101).

Figure 4:
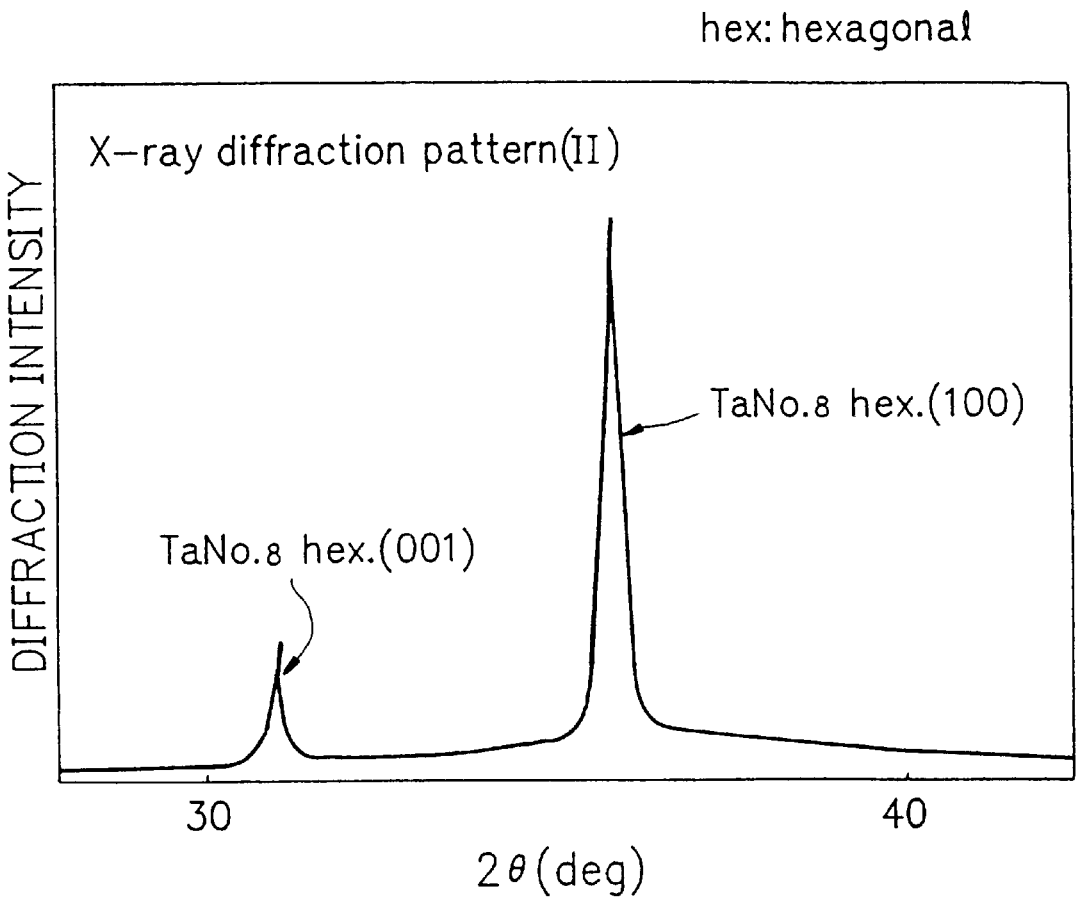
FIG. 4 shows a X-ray diffraction pattern of a resistor layer composed of a $TaN_{0.8hex}$-containing tantalum nitride material according to the present invention.

In the X-ray diffraction pattern (II), as shown in FIG. 4, there were observed a peak corresponding to $TaN_{0.8hex}$ (100) in a region of about 350 to about 360 in value of 20 and another peak corresponding to $TaN_{0.8hex}$ (001) in a region of about 31° in value of 20.

And the tantalum nitride film having the peak of $TaN_{0.8hex}$ (100) was found to have been formed when the partial pressure of the $N_2$ gas was adjusted at or near 24%.

Separately, the tantalum nitride film having the Xray diffraction pattern-(II) was subjected to analysis with respect to its chemical composition by means of EPMA. Examination was made of the analyzed-results. As a result, it was found that the X-ray diffraction pattern (II) is of neither $Ta_2N_{hex}$ nor $TaN_{hex}$ but is of a tantalum nitride film containing $TaN_{0.8hex}$, based on the ASTM and JCPDS standard data.

Now, among the resultant tantalum nitride films, there were found some films containing, other than the above described $TaN_{0.8hex}$ (100), $Ta_2N_{hex}$ or $TaN_{hex}$, X-ray diffraction patterns of these films are not shown.

And these films containing, other than the $TaN_{0.8hex}$ (100), $Ta_2N_{hex}$ or $TaN_{hex}$ were found to have been formed when the partial pressure of the $N_2$ gas was adjusted to a value in the region of 21% to 27% excluding the region of near 24%.

Based on the above described results, there was obtained a finding that a tantalum nitride film having a structure in which a $TaN_{0.8hex}$ (100) is strongly oriented is obtained in the case of the partial pressure of the $N_2$ gas is adjusted at or near 24%.

There were obtained further findings. That is, the film-forming parameters (including the substrate temperature, temperature of the gaseous atmosphere in the film-forming space, DC power applied, partial pressure of the $N_2$ gas) of causing the formation of a desired tantalum nitride film substantially comprising $TaN_{0.8hex}$ only or comprising $TaN_{0.8hex}$, and $Ta_2N_{hex}$ or $TaN_{hex}$ are somewhat different depending upon a film-forming apparatus (that is, a sputtering apparatus) to be employed. Therefore, these film-forming parameters are difficult to be generalized, and they should be properly determined depending upon the film-forming apparatus to be employed.

In this connection, particularly, the above described parameter relating to the partial pressure of the $N_2$ gas which caused the formation of the foregoing tantalum nitride film substantially comprising $TaN_{0.8hex}$ only or the foregoing tantalum nitride film comprising $TaN_{0.8hex}$ and $Ta_2N_{hex}$ or $TaN_{hex}$ is one that had been previously determined for the film-forming apparatus of FIG. 12 used in the above.

Incidentally, in order to repeat a step of instantly conducting vaporization of printing liquid (ink) and contraction of vaporized ink in a liquid jet head, it is necessary to conduct a step of conducting heating and cooling within a very short period of time of several usec to several tens usec. In addition, in order to instantly conduct the vaporization of ink, it is necessary for the interface between the heat generating resistor and the ink to be heated instantly and intermittently to a temperature corresponding to a value (specifically, 300° C. in terms of the water temperature) of about 3 holds over the boiling point of water (100° C.), wherein the heat generating resistor is instantly and intermittently heated to a temperature of 600° C. to 900° C. Thus, as for the stacked structure in the liquid jet head, it is necessary to be properly designed while having a due care not only about the heat resistance of the heat resistant protective film for the heat generating resistor but also about the stress, adhesion, possibility of causing changes in the physical and chemical properties of the constituent material of the heat generating resistor.

In view of this, there were prepared a plurality of liquid jet heads each having one of the foregoing substrates with one of the foregoing tantalum nitride films having one of the X-ray diffraction patterns (I) to (III) as the heat generating resistor layer. Each of the resultants was evaluated with respect to breakdown voltage ratio when the tantalum nitride film as the heat generating resistor layer is ruptured.

The evaluation was conducted in the following manner. That is, a pulse signal of 7 $\mu$sec was applied to the liquid jet head to obtain a threshold voltage $V_{th}$ for commencing discharge of printing liquid (ink). Thereafter, about $1\times10^5$ pulses were continuously applied under condition of 2 kHz while continuously impressing an applied voltage while increasing its value every 0.02 $V_{th}$ starting from said threshold voltage $V_{th}$, until a rupture was occurred at the heat generating resistor layer. The applied voltage when the rupture was occurred was made to be a breakdown voltage $V_b$. Based on the threshold voltage $V_{th}$ and the breakdown voltage $V_b$, there was obtained a breakdown voltage ratio $K_b$ ($=V_b/V_{th}$).

Based on the results obtained, there was obtained a finding that the higher the rupture voltage ratio $V_b$ is, the higher the resistance of the heat generating resistor layer is.

In addition, there were prepared a plurality of liquid jet heads (specifically, ink jet heads) each having one of the foregoing substrates with one of the foregoing tantalum nitride films having one of the X-ray diffraction patterns (I) to (III) as the heat generating resistor layer. Using these ink jet heads, there were prepared a plurality of liquid jet apparatus (specifically, ink jet printers).

Each of the resultant ink jet printers was examined with respect to durability of the heat generating resistor layer in the following manner. That is, printing was continuously conducted under conditions of 7 $\mu$sec for the pulse signal, 1.2 $V_{th}$ for the voltage applied (this 1.2 $V_{th}$ is corresponding to a value which is 1.2 holds over the threshold voltage), and at most 3 kHz for the driving frequency for discharging ink, wherein a print test pattern was continuously printed on a plurality of A4-sized papers. After the number of the printing papers having been subjected to printing reached a predetermined number, as for the heat generating resistor layer, examination was conducted of a rate of change ($R_1/R_0$) between its initial resistance value $R_0$ and its resistance value $R_1$ after the printing. Based on the results obtained, there were obtained findings that when the change of rate $R_1/R_0$ is about 20% or more, ink discharging is not conducted as desired and there cannot be obtained a desirable printed image, and that when the change of rate $R_1/R_0$ is about 10%, there is occurred a certain variation between the printed images obtained at the initial stage and the printed images obtained after repetitions of the printing in terms of the quality.

There were obtained further findings based on the above experimental results with respect to change of rate $R_1/R_0$. as will be described below.

When any of the tantalum nitride ($Ta_2N_{hex}$) films formed under condition of about 20% in terms of the $N_2$ gas partial pressure and having the X-ray diffraction pattern (I) shown in FIG. 3 is used as the heat generating resistor layer, the change of rate $R_1/R_0$ is apparently high. As for the reason, it is considered that upon continuously conducting printing over a long period of time at a fixed apply voltage, the heat generating resistor layer is gradually decreased in terms of the resistance value wherein the electric current flown into the heat generating resistor layer is gradually increased, resulting in causing a rapture at the heat generating resistor layer. The occurrence of such rapture at the heat generating resistor layer entails a serious problem for an ink jet head in that the ink jet head becomes useless. Thus, any of the $Ta_2N_{hex}$ films exhibits a behavior in that the resistance value is apparently decreased upon repeated use, and therefore, they are not suitable for use as the heat generating resistor layer in an ink jet head.

Figure 5:
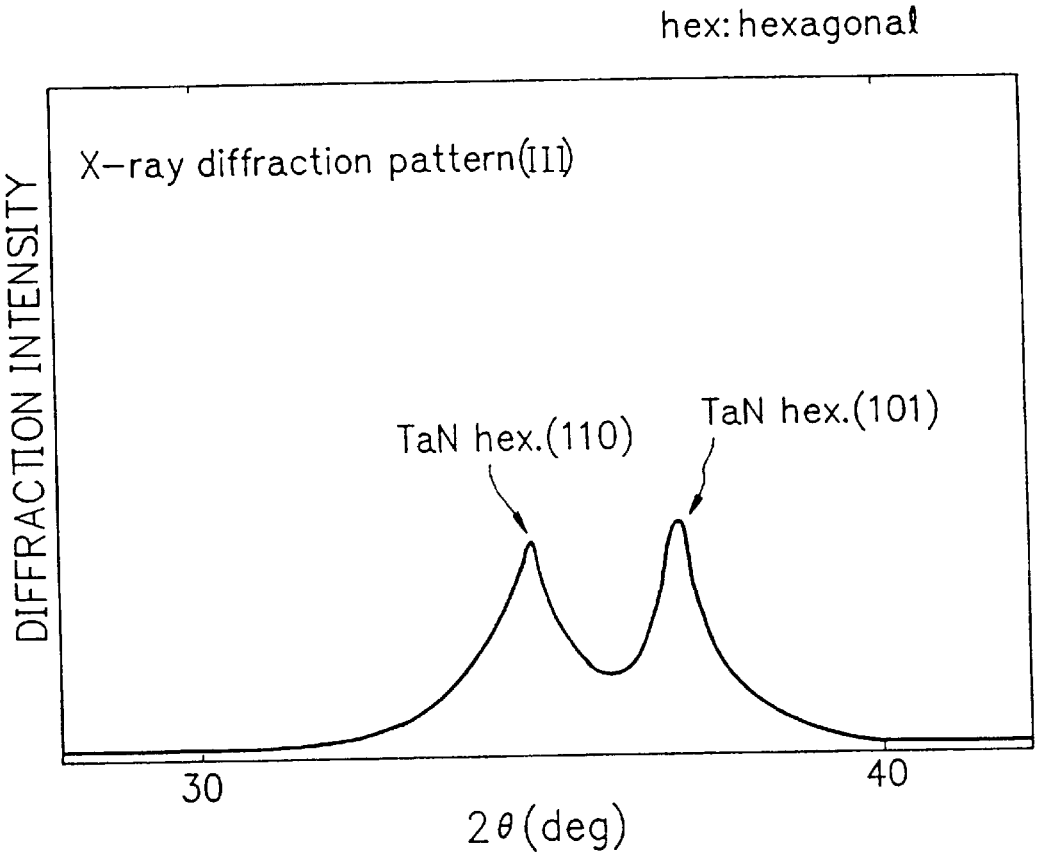
FIG. 5 shows a X-ray diffraction pattern of a conventional resistor layer composed of $TaN_{hex}$.

Further, when any of the tantalum nitride ($TaN_{hex}$) films formed under condition of about 30% for the $N_2$ gas partial pressure and having the X-ray diffraction pattern (III) shown in FIG. 5 is used as the heat generating resistor layer, there is a tendency for the heat generating resistor to be gradually increased in terms of the resistance value upon repeated use over a long period of time, wherein the electric current flown into the heat generating resistor layer is gradually decreased to decrease the quantity of a thermal energy generated by the heat generating resistor, resulting in causing a variation for the quantity of ink discharged. Therefore, the tantalum nitride ($TaN_{hex}$) films having the X-ray diffraction pattern (III) shown in FIG. 5 are not suitable for use as the heat generating resistor layer in an ink jet head.

As for the tantalum nitride ($TaN_{0.8hex}$) films having the X-ray diffraction pattern (II) shown in FIG. 4, there were obtained findings as will be described below.

That is, any of these tantalum nitride films is 1.6 or more in breakdown voltage ratio Kb which is markedly high and apparently small in terms of the change of rate $R_1/R_0$. Thus, any of the tantalum nitride ($TaN_{0.8hex}$) films having the X-ray diffraction pattern (II) shown in FIG. 4 is extremely suitable for use as the heat generating resistor layer in an ink jet head.

The use of any of the tantalum nitride ($TaN_{0.8hex}$) films having the X-ray diffraction pattern (II) shown in FIG. 4 as the heat generating resistor layer enables to obtain a highly reliable ink jet head which stably and continuously provides a high quality printed image over a long period of time even in the case where printing conducted at an increased driving voltage wherein the heat generating resistor layer is maintained in a desirable state without being ruptured and without being deteriorated in terms of the heat generating performance, without suffering from the-foregoing problems found in the case of using the tantalum nitride ($Ta_2N_{hex}$) films having the X-ray diffraction pattern (I) shown in FIG. 3 and in the case of using the tantalum nitride ($TaN_{hex}$) films having the X-ray diffraction pattern (III) shown in FIG. 5.

Particularly, an ink jet head having a heat generating resistor layer comprising any of the tantalum nitride ($TaN_{0.8hex}$) films having the X-ray diffraction pattern (II) shown in FIG. 4 is such that the heat generating resistor is markedly high in terms of the breakdown voltage ratio $K_b$, it is hardly deteriorated in terms of the resistance value even upon repeated use over a long period of time, and it always functions to cause a stable bubble at ink even at an increased driving voltage, resulting in providing a high quality printed image.

Now, the point by which the tantalum nitride ($TaN_{0.8hex}$) films having the X-ray diffraction pattern (II) shown in FIG. 4 are clearly distinguished from any of the tantalum nitride ($Ta_2N_{hex}$) films having the X-ray diffraction pattern (I) shown in FIG. 3 and the tantalum nitride ($TaN_{hex}$) films having the X-ray diffraction pattern (III) shown in FIG. 5 is that any of the tantalum nitride ($TaN_{0.8hex}$) films has a crystalline structure with a $TaN_{0.8hex}$ (100) which any of the tantalum nitride ($Ta_2N_{hex}$) films tantalum nitride ($TaN_{hex}$) films does not have.

The present invention has been accomplished based on the above described findings.

As above described, in a liquid jet head according to the present invention, a protective layer is usually disposed above the heat generating resistor layer having a heat acting portion with a heat acting face and also above the electrodes situated under a region wherein printing liquid (ink) is flown or stays. The protective layer serves to prevent the electrodes and the heat acting portion from being chemically or/and physically damaged by ink. The protective layer further functions to prevent occurrence of a short-circuit among the electrodes, specifically between common electrodes or between selective electrodes. Further in addition, the protective layer functions to prevent the electrodes from being electrically corroded as a result of being contacted with ink wherein the ink is energized.

As for the protective layer, the characteristics required therefor are different depending upon the position where it is disposed. For instance, when it is disposed above the heat acting portion, it is required to be excellent in (i) heat resistance, (ii) resistance to printing liquid (ink), (iii) property of preventing penetration of printing liquid (ink), (iv) thermal conductivity, (v) resistance to oxidation, (vi) insulating property, and (vii) resistance to damage. In the case where it is disposed in a region other than the heat acting portion, although the conditions relating to thermal factors can be relatively relaxed, it is still required to be excellent in the above items (ii), (iii), (vi) and (vii).

As of the present time, there has not been found such an appropriate material which enables to provide a single-layered protective layer capable of covering the heat acting portion of the heat generating resistor and the electrodes while satisfying all the requirements (i) to (vii). Therefore, in practice, a multi-layered protective layer comprising a plurality of layers each being capable of exhibiting characteristics to satisfy the requirements for the protective layer disposed at a given position is disposed in a liquid jet head. It is a matter of course that the multi-layered protective layer is necessary to be designed such that a sufficient adhesion is ensured among the constituent layers so that no layer removal is occurred not only upon producing a liquid jet head but also upon repeated use over a long period of time.

Further, in the production of a liquid jet head provided with an increased number of discharging outlets in which a number of small electrothermal converting bodies are disposed, the formation of a plurality of layers including a protective layer and the removal of partial portions of the layers formed are repeatedly conducted, wherein in the step of forming the protective layer, the rear of the protective layer becomes to have a plurality of minute irregularities of forming steps, and because of this, it is important for the protective layer to be formed a state that the layer excels in step coverage. In the case where the protective layer is insufficient in terms of the step coverage, a problem entails in that printing liquid (ink) is often penetrated through portions of the protective layer, which are poor in step coverage, to cause an electric corrosion or/and dielectric breakdown at such defective portion. Further, there is a tendency for the protective layer to be accompanied by certain defects depending upon the process employed for the formation thereof. In this case, printing liquid (ink) is liable to penetrate through such defects to arrive at the electrothermal converting body to thereby damage said electrothermal converting body.

In view of the above description, it is desired for the protective layer to be excellent in step coverage and to be substantially free of pinhole or like other defects.

Particularly, the heat acting face of the heat generating resistor is exposed to severe conditions of repetition of a cycle in which a temperature change between lowered temperature and elevated temperature is conducted several thousands times per a second, wherein printing liquid (ink) situated above the heat acting face is vaporized to cause a bubble at the time of the elevated temperature whereby raising the pressure in a liquid pathway and at the time of the lowered temperature, the vaporized ink is contracted to extinguish the bubble wherein the pressure in the ink pathway is reduced. In this case, the heat acting face is repeatedly suffered from a remarkable mechanical stress caused by the repetition of the above step. Therefore, as for the multi-layered protective layer to be disposed so as to cover the heat acting face, it is required to be excel not only in shock resistance against such mechanical stress but also in adhesion among the constituent layers.

Taking account of the above situations for the protective layer, the present inventors prepared a plurality of substrates having the configuration shown in FIG. 1 for an ink jet heads (substrate samples Nos. 1 to 5) each having a heat generating resistor layer formed of the foregoing $TaN_{0.8}$-containing tantalum nitride film having the X-ray diffraction pattern shown in FIG. 4. Using these substrate samples, there were prepared a plurality of ink jet heads, evaluation was made with respect to ink jet printing characteristics.

Each of the substrate samples Nos. 1 to 5 was prepared in the following manner.

Preparation of Substrate Sample No. 1 and an Ink Jet Head Provided with this Substrate:

On a single crystal silicon wafer as the support member 101, a 1.2 $\mu$m thick $SiO_2$ film as the heat accumulating layer 102 was formed by means of a conventional thermal oxidation process. On the heat accumulating layer thus formed, a 1.2 $\mu$m thick Si:O:N film as the interlayer film 103 was formed by means of a conventional plasma CVD process wherein $SiH_4$ gas and $N_2O$ gas were used as the film-forming raw material gas. Successively, on the interlayer film 103, there was formed a 1000 Å thick $TaN_{0.8hex}$-containing tantalum nitride film as the heat generating resistor layer 104 in accordance with the foregoing reactive sputtering process using the film-forming apparatus shown in FIG. 12.

Then, on the heat generating resistor layer 104 thus formed, there were formed Al electrodes (comprising common and selective electrodes) 105 by means of a conventional sputtering process wherein an Al-target was sputtered in an Ar gas atmosphere. Thereafter, a 1 $\mu$m thick Si:N film as the protective layer 106 was formed by means of a conventional plasma CVD process wherein $SiH_4$ gas and $NH_3$ gas were used as the film-forming raw material gas. Finally, on the protective layer 106 thus formed, a 2000 Å thick Ta film as the cavitation preventive layer 107 was formed by means of a conventional sputtering process in which a Ta-target was sputtered in a Ar gas atmosphere.

Thus, there was obtained a substrate for an ink jet head (that is, a substrate sample No. 1).

This substrate was joined to a grooved top plate, which was separately provided, such that the heat acting portion of the heat generating resistor layer of the substrate was positioned to face to a liquid pathway formed. Then, to an end portion of the liquid pathway, a discharging outlet-forming plate was mounted. Thus, there was obtained an ink jet head (hereinafter referred to as head sample No. 1).

Preparation of Substrate Sample No. 2 and an Ink Jet Head Provided with this Substrate:

The procedures of preparing the substrate sample No. 1 were repeated, except that a 1.2 $\mu$m thick Si:N film as the interlayer film 103 was formed by a conventional plasma CVD process wherein $SiH_4$ gas and $NH_3$ gas were used as the film forming raw material gas, to thereby obtain a substrate for an ink jet head (substrate sample 2).

Using the resultant substrate sample No. 2, there was prepared an ink jet head (head sample No. 2) in the same manner as in the case of preparing the head sample No. 1.

Preparation of Substrate Sample No. 3 and an Ink Jet Head Provided with this Substrate:

The procedures of preparing the substrate sample No. 1 were repeated, except that a 1 Mm thick Si:O:N film as the protective layer 106 was formed by a conventional plasma CVD process wherein $SiH_4$ gas and $N_2O$ gas were used as the film forming raw material gas, to thereby obtain a substrate for an ink jet head (substrate sample 3).

Using the resultant substrate sample No. 3, there was prepared an ink jet head (head sample No. 3) in the same manner as in the case of preparing the head sample No. 1.

Preparation of Substrate Sample No. 4 and an Ink Jet Head Provided with this Substrate:

The procedures of preparing the substrate sample No. 1 were repeated, except that a 1 $\mu$m thick $SiO_2$ film as the protective layer 106 was formed by a conventional plasma CVD process wherein $SiH_4$ gas and $O_2$ gas were used as the film forming raw material gas, to thereby obtain a substrate for an ink jet head (substrate sample 4).

Using the resultant substrate sample No. 4, there was prepared an ink jet head (head sample No. 4) in the same manner as in the case of preparing the head sample No. 1.

Preparation of Substrate Sample No. 5 and an Ink Jet Head Provided with this Substrate:

The procedures of preparing the substrate sample No. 1 were repeated, except that a 1.2 Mm thick $SiO_2$ film as the interlayer film 103 was formed by a conventional RF-sputtering process wherein a Si-target was sputtered in an gaseous atmosphere containing $O_2$ gas, to thereby obtain a substrate for an ink jet head (substrate sample 5).

Using the resultant substrate sample No. 5, there was prepared an ink jet head (head sample No. 5) in the same manner as in the case of preparing the head sample No. 1.

Each of the resultant head samples Nos. 1 to 5 was subjected to SST Test (Step Stress Test). The SST Test herein was conducted in the following manner. That is, a pulse signal of 7 $\mu$sec was applied to the head sample to obtain a threshold voltage $V_{th}$ for commencing ink discharging. Thereafter, about $1\times10^5$ pulses were continuously applied under condition of 2 kHz while continuously impressing an applied voltage while increasing its value every 0.02 $V_{th}$ starting from said threshold voltage $V_{th}$, until a rupture was occurred at the heat generating resistor layer. The applied voltage when the rupture occurred was made to be a breakdown voltage $V_b$. Based on the threshold voltage $V_{th}$ and the breakdown voltage $V_b$, there was obtained a breakdown voltage ratio $K_b$ ($=V_b/V_{th}$). The results obtained are collectively shown in Table 1.

Based on the results shown in Table 1, the following facts are understood. That is, any of the head samples is Nos. 1 to 5 of 1.7 to 1.8 in breakdown voltage ratio $K_b$ and thus, excels in quality. In view of this, the use of any of the substrate samples Nos. 1 to 5 provides a highly reliable ink jet head.

It is also understood that the heat generating resistor formed of a $TaN_{0.8hex}$-containing tantalum nitride film in an ink jet head is hardly deteriorated in terms of the resistance value even upon repeated use over a long period of time and thus, it excels in durability and is highly reliable.

Further in addition, a further fact is understood. That is, as apparent from the above description, any of the substrate samples Nos. 1 to 5 comprises a stacked structure comprising heat accumulating layer/heat generating layer with a heat acting portion/protective layer/cavitation preventive layer in which electrodes are disposed between the heat generating resistor layer and protective layer, wherein each of the heat accumulating layer, protective layer and cavitation preventive layer is composed of a material containing at least one kind of atom of the constituent atoms of the heat generating resistor layer. Because of this, the stacked structure is assured in terms of the adhesion among the constituent layers and excels in durability, and thus, the heat generating resistor layer is hardly deteriorated in terms of the heat generating performance even upon repeated use over a long period of time. This situation leads to providing a highly reliable ink jet head which stably and continuously conducts ink discharging in a desirable state, resulting in providing a high quality printed image, even upon repeated use over a long period of time.

The present invention will be described with reference to examples, which are for illustrative purposes only and are not intended to restrict the scope of the present invention.

Prior to describing the examples, description will be made of the interrelation between the lifetime of the heat generating resistor layer and the driving voltage ($V_{op}$) impressed to the heat generating resistor layer in a liquid jet head.

In recent years, an improvement has been made in an liquid jet head such that it enables to satisfy a demand for miniaturization thereof, another demand for attaining an extremely high quality printed image, and a further demand for attaining color printing. In view of this, in the liquid jet heads in recent years, their heat generating resistor layer is operated at a driving voltage $V_{op}$ of an increased K-value.

The impression of the driving voltage to the heat generating resistor layer in a conventional liquid jet head is conducted by virtue of the single pulse driving based on only a main pulse dedicated for discharging printing liquid (ink). However, in the recent liquid jet heads, the so-called double pulsating driving manner is usually employed.

Figure 6:
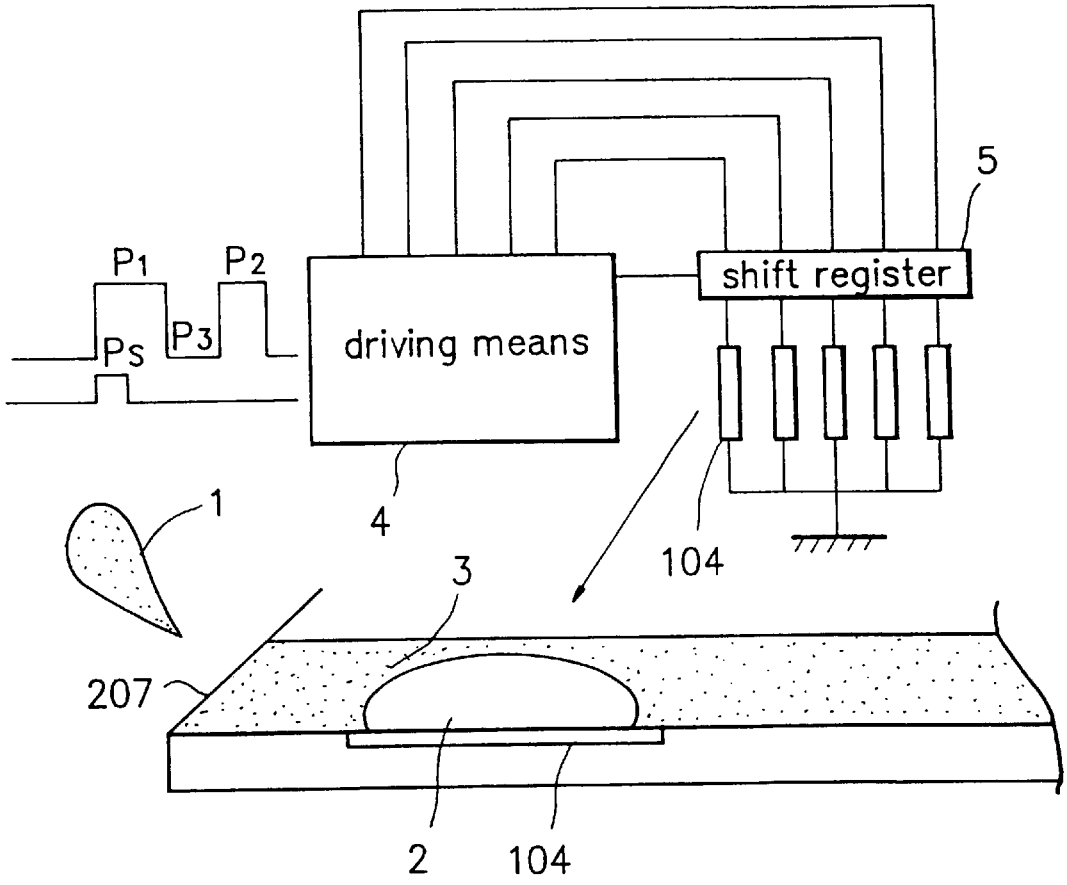
FIG. 6 is a schematic explanatory view when a bubble is caused at liquid (specifically, ink) in a substrate for a liquid jet head upon conducting printing in the double pulsating driving manner.

Description will be made of the double pulsating driving manner with reference to FIG. 6. As shown in FIG. 6, the double pulsating driving manner comprises a main pulse $P_2$, a sub-pulse $P_1$, and a quiescent time $P_3$ between the $P_2$ and $P_1$. By properly adjusting the length of the subpulse $P_1$ and the quiescent time $P_3$, the quantity of ink discharged and the temperature of the substrate for a liquid jet head can be properly adjusted as desired.

As shown in FIG. 6, respective driving pulses are applied to a heat generating resistor layer 104 through a driving means 4 and a shift register 5. By this, a bubble 2 is generated at ink 3 in a discharging outlet 207 to cause discharging of an ink droplet 1.

In the case where the substrate is maintained at a relatively low temperature of, for instance, about 10° C., ink becomes highly viscous and because of this, the quantity of ink discharged is decreased. In such case, by elongating the width of the sub-pulse to a certain extend, the quantity of ink discharged can be properly increased. On the other hand, in the case where the substrate is maintained at a relatively high temperature of, for instance, about 50° C., by shortening the width of the sub-pulse to a certain extend, the quantity of ink discharged can be properly decreased.

Thus, in accordance with the double pulsating manner, there can be continuously obtained an identical printed image under various environmental conditions.

Now, in the case where the substrate is maintained at a relatively low temperature, it is necessary to increase the electric power applied to the heat generating resistor layer, wherein the heat generating resistor layer is liable to be deteriorated as well as in the case where the K-value is increased, resulting in shortening the lifetime thereof.

Separately, in the case of preparing a number of heat generating resistor layers in an identical film-forming chamber, in order to obtain a number of liquid jet heads, the resultant liquid jet heads are often varied in terms of the quality, because their heat generating resistor layers are more or less varied in terms of the heat generating performance depending upon the position of the film-forming chamber where the formation thereof is conducted. Thus, it is necessary to properly adjust the driving voltage impressed for each liquid jet head.

For this purpose, there has been made such a manner as will be described in the following. That is, upon forming the heat generating layer, a resistor layer (a so-called dummy heater) incapable of dedicating for discharging printing liquid (ink) is formed in the vicinity of the heat generating resistor layer. And the resistance value of said resistor (that is, the dummy heater) is measured to thereby estimate the resistance value of the heat generating resistor layer actually dedicated for discharging ink. Based on the estimated resistance value, the driving voltage impressed to the liquid jet head is properly adjusted. This manner is often called "resistance ranking manner" in this technical field.

However, such estimated resistance value unavoidably case a somewhat difference from the actual resistance value of the heat generating resistor layer mainly due to a variation in the resistance values of the electrodes, and an error in the resistance value reading on the side of an apparatus body in which a liquid jet head is mounted. Such difference corresponding to a value of about ±0.1 in terms of the K-value. In order to maintain a value of 1.1 in terms of the minimum K-value which is necessary to attain a stable quality for an image printed, it is necessary to adjust the K-value at a value of 1.2±0.1. In a certain liquid jet head, the K-value of 1.3 is sometimes employed, wherein the heat generating resistor layer is liable to be suffered from a damage, resulting in shortening the lifetime thereof.

Further, in the case where a liquid jet head is operated in the double pulsating driving manner under relatively low temperature environmental conditions, the maximum K-value sometimes becomes to be of a value of 1.35 to 1.4.

Therefore, in the case where a liquid jet head having a heat generating resistor composed of $HfB_2$ is operated in the above described manner, it is difficult attain a lifetime for the heat generating resistor layer which is similar to the lifetime of a conventional liquid jet apparatus which is considered to capable of attaining printing for 20,000 printing sheets. In view of this, it is generally considered that a liquid jet head having a heat generating resistor composed of $HfB_2$ should used in the form of an exchangeable type liquid jet head integrally provided with an ink tank which can attain printing for a limited number of printing sheet and which is of a relatively short lifetime.

Now, the examples belonging to the present invention will be described.

As will be described in the following examples 1 to 7, there was prepared a liquid jet head having a heat generating resistor layer formed of a film composed of a $TaN_{0.8hex}$-containing tantalum nitride material having the X-ray diffraction pattern (II) shown in FIG. 4 in each example.

That is, seven kinds of heat generating resistor layers each comprising a film composed of a different $TaN_{0.8hex}$-containing tantalum nitride material were obtained. These seven different $TaN_{0.8hex}$-containing tantalum nitride films were formed in accordance with the foregoing reactive sputtering process using the film-forming apparatus shown in FIG. 12 under condition of 21 to 27% for the partial pressure of the $N_2$ gas. As for each of these $TaN_{0.8hex}$-containing tantalum nitride films, examination was made with respect to its chemical composition in terms of the content ratio (mol. %) of a given tantalum nitride material (crystal) and also in terms of the composition ratio x of said given tantalum nitride material in view of $Ta_xN$ by means of the X-ray diffraction and RBS (Rutherford Backscattering Spectrometry). The determination of the x value was conducted by repeating the measurements by the X-ray diffraction and RBS were repeated three times, and obtaining a mean value based on the measured results obtained. The examined results obtained are collectively shown in Table 2. Incidentally, any of the seven $TaN_{0.8hex}$-containing tantalum nitride films was found to have the X-ray diffraction pattern shown in FIG. 4.

Based on the examined results, it was found that any of seven $TaN_{0.8hex}$-containing tantalum nitride films contains at least $TaN_{0.8hex}$, and some of them further contains $Ta_2N_{hex}$ or $TaN_{hex}$.

EXAMPLE 1

In this example, there was firstly prepared a substrate for an ink jet head, having the configuration shown in FIG. 1, and using the resultant substrate, there was prepared an ink jet head.

Preparation of Substrate for a Ink Jet Head:

There was firstly provided a single crystal silicon wafer for a liquid jet head as the support member 101.

The surface of the silicon wafer was well cleaned by a conventional plasma cleaning manner.

On the cleaned surface of the silicon wafer as the support member 101, a 1.2 $\mu$m thick $SiO_2$ film as the heat accumulating layer 102 was formed by means of a conventional thermal oxidation process. On the heat accumulating layer thus formed, a 1.2 $\mu$m thick Si:O:N film as the interlayer film 103 was formed by means of a conventional plasma CVD process wherein $SiH_4$ gas and $N_2O$ gas were used as the film-forming raw material gas. Successively, on the interlayer film 103, there was formed a 1000 Å thick tantalum nitride film substantially composed of $TaN_{0.8hex}$ only and having a value of 1.2 in terms of the x value as shown in Table 2 and having the X-ray diffraction pattern (II) shown in FIG. 4, as the heat generating resistor layer 104 in accordance with the foregoing reactive sputtering process using the film-forming apparatus shown in FIG. 12, wherein the film formation was conducted under conditions of 24% for the partial pressure of the $N_2$ gas, 7.5 mTorr for the total pressure of the gaseous mixture composed of the Ar and $N_2$ gases, 2.0 kW for the sputtering DC power, 200° C. for the temperature of the film-forming gaseous atmosphere, and 200° C. for the substrate temperature.

Then, on the heat generating resistor layer 104 thus formed, there were formed an Al film having a thickness about 5,500 Å (capable of dedicating for the formation of electrodes 105 comprising common and selective electrodes) by means of a conventional sputtering process using the film-forming apparatus used for the formation of the heat generating resistor layer wherein an Al-target was sputtered in an Ar gas atmosphere. The resultant was subjected to patterning by a convention patterning process, to form a heat acting portion (108) having a heat acting face with no Al film thereon while forming the electrodes 105. Thereafter, a 1 $\mu$m thick Si:N film as the protective layer 106 was formed by means of a conventional plasma CVD process wherein $SiH_4$ gas and $NH_3$ gas were used as the film-forming raw material gas. Finally, on the protective layer 106 thus formed, a 2000 Å thick Ta film as the cavitation preventive layer 107 was formed by means of a conventional sputtering process in which a Ta-target was sputtered in a Ar gas atmosphere.

Thus, there was obtained a substrate for an ink jet head. In this way, there were obtained a plurality of substrates for an ink jet head.

Preparation of Ink Jet Head:

Each of the substrates obtained in the above was joined to a grooved top plate, which was separately provided, such that the heat acting portion of the heat generating resistor layer of the substrate was positioned to face to a liquid pathway formed. Then, to an end portion of the liquid pathway, a discharging outlet-forming plate was mounted. Thus, there were obtained a plurality of ink jet heads.

EXAMPLE 2

Figure 7:
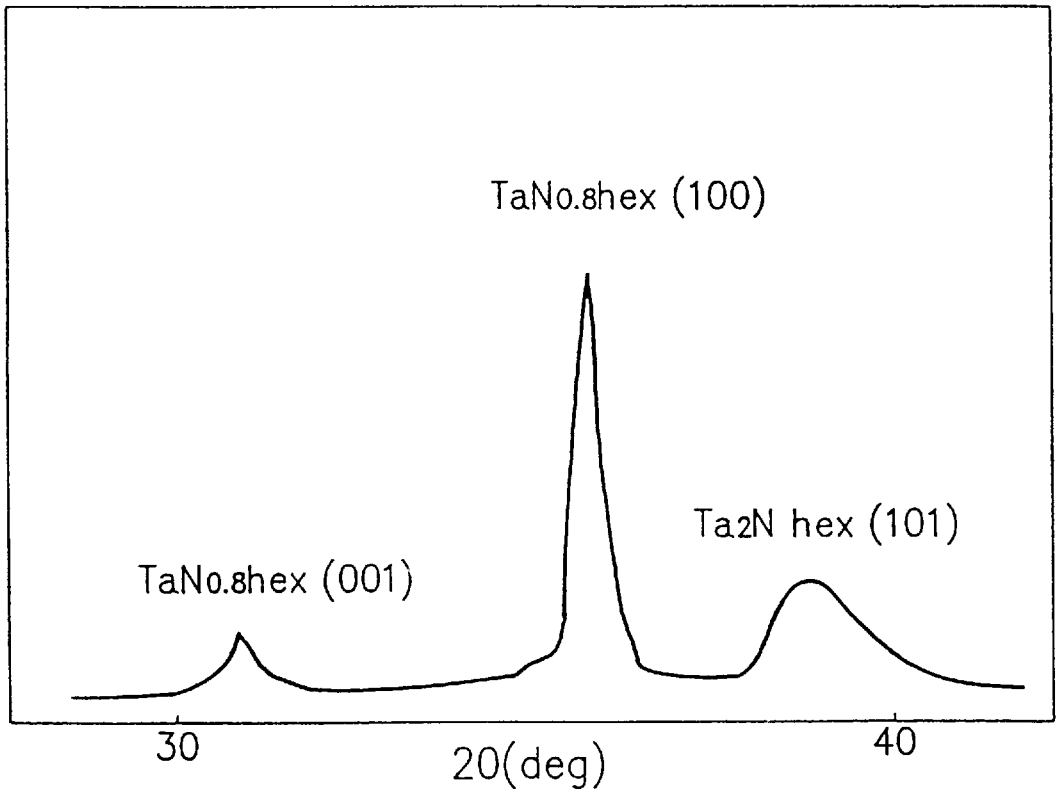
FIG. 7 shows a X-ray diffraction pattern of a resistor layer composed of a $TaN_{0.8hex}$-containing tantalum nitride material obtained in Example 2 belonging to the present invention, which will be later described.

The procedures of Example 1 were repeated, except that the heat generating resistor layer was formed of a 1000 Å thick tantalum nitride film composed of $TaN_{0.8hex}$ and $Ta_2N_{hex}$ and having a value of 1.85 in terms of the X value as shown in Table 2 and having a X-ray diffraction pattern shown in FIG. 7, formed by repeating the procedures for the formation of the heat generating resistor layer in Example 1 except for changing the partial pressure of the $N_2$ gas to 21%, to thereby obtain a plurality of substrates for an ink jet head.

Using each of the substrates thus obtained, there were prepared a plurality of ink jet heads in the same manner as in Example 1.

EXAMPLE 3

Figure 8:
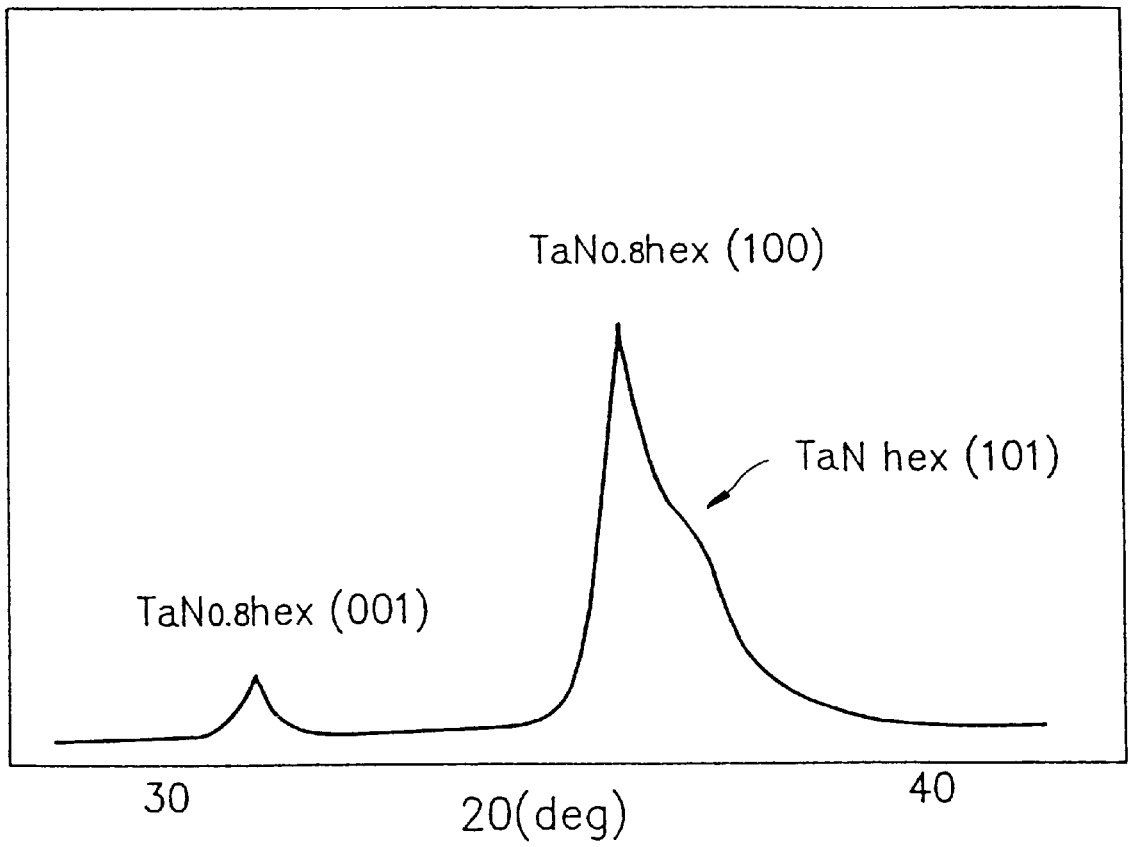
FIG. 8 shows a X-ray diffraction pattern of a resistor layer composed of a $TaN_{0.8hex}$-containing tantalum nitride material obtained in Example 3 belonging to the present invention, which will be later described.

The procedures of Example 1 were repeated, except that the heat generating resistor layer was formed of a 1000 Å thick tantalum nitride film composed of $TaN_{0.8hex}$ and $TaN_{hex}$ and having a value of 1.05 in terms of the X value as shown in Table 2 and having a X-ray diffraction pattern shown in FIG. 8, formed by repeating the procedures for the formation of the heat generating resistor layer in Example 1 except for changing the partial pressure of the $N_2$ gas to 27%, to thereby obtain a plurality of substrates for an ink jet head.

Using each of the substrates thus obtained, there were prepared a plurality of ink jet heads in the same manner as in Example 1.

EXAMPLE 4

The procedures of Example 1 were repeated, except that the heat generating resistor layer was formed of a 1000 Å thick tantalum nitride film composed of $TaN_{0.8hex}$ and $Ta_2N_{hex}$ and having a value of 1.4 in terms of the X value as shown in Table 2, formed by repeating the procedures for the formation of the heat generating resistor layer in Example 1 except for changing the partial pressure of the $N_2$ gas to 23%, to thereby obtain a plurality of substrates for an ink jet head.

Using each of the substrates thus obtained, there were prepared a plurality of ink jet heads in the same manner as in Example 1.

EXAMPLE 5

The procedures of Example 1 were repeated, except that the heat generating resistor layer was formed of a 1000 Å thick tantalum nitride film composed of $TaN_{0.8hex}$ and $Ta_2N_{hex}$ and having a value of 1.625 in terms of the X value as shown in Table 2, formed by repeating the procedures for the formation of the heat generating resistor layer in Example 1 except for changing the partial pressure of the $N_2$ gas to 22%, to thereby obtain a plurality of substrates for an ink jet head.

Using each of the substrates thus obtained, there were prepared a plurality of ink jet heads in the same manner as in Example 1.

EXAMPLE 6

The procedures of Example 1 were repeated, except that the heat generating resistor layer was formed of a 1000 Å thick tantalum nitride film composed of $TaN_{0.8hex}$ and $TaN_{hex}$ and having a value of 1.2 in terms of the X value as shown in Table 2, formed by repeating the procedures for the formation of the heat generating resistor layer in Example 1 except for changing the partial pressure of the $N_2$ gas to 25%, to thereby obtain a plurality of substrates for an ink jet head.

Using each of the substrates thus obtained, there were prepared a plurality of ink jet heads in the same manner as in Example 1.

EXAMPLE 7

The procedures of Example 1 were repeated, except that the heat generating resistor layer was formed of a 1000 Å thick tantalum nitride film composed of $TaN_{0.8hex}$ and $TaN_{hex}$ and having a value of 1.125 in terms of the X value as shown in Table 2, formed by repeating the procedures for the formation of the heat generating resistor layer in Example 1 except for changing the partial pressure of the $N_2$ gas to 26%, to thereby obtain a plurality of substrates for an ink jet head.

Using each of the substrates thus obtained, there were prepared a plurality of ink jet heads in the same manner as in Example 1.

EVALUATION

Each of the liquid jet heads obtained in Examples 1 to 7 was evaluated by means of the SST Test (Step Stress Test), CST Test (Constant Stress Test, or heat pulse durability test in other words), and PD Test (Printing Durability Test).

The SST Test was conducted in the same manner as previously described.

Figure 9:
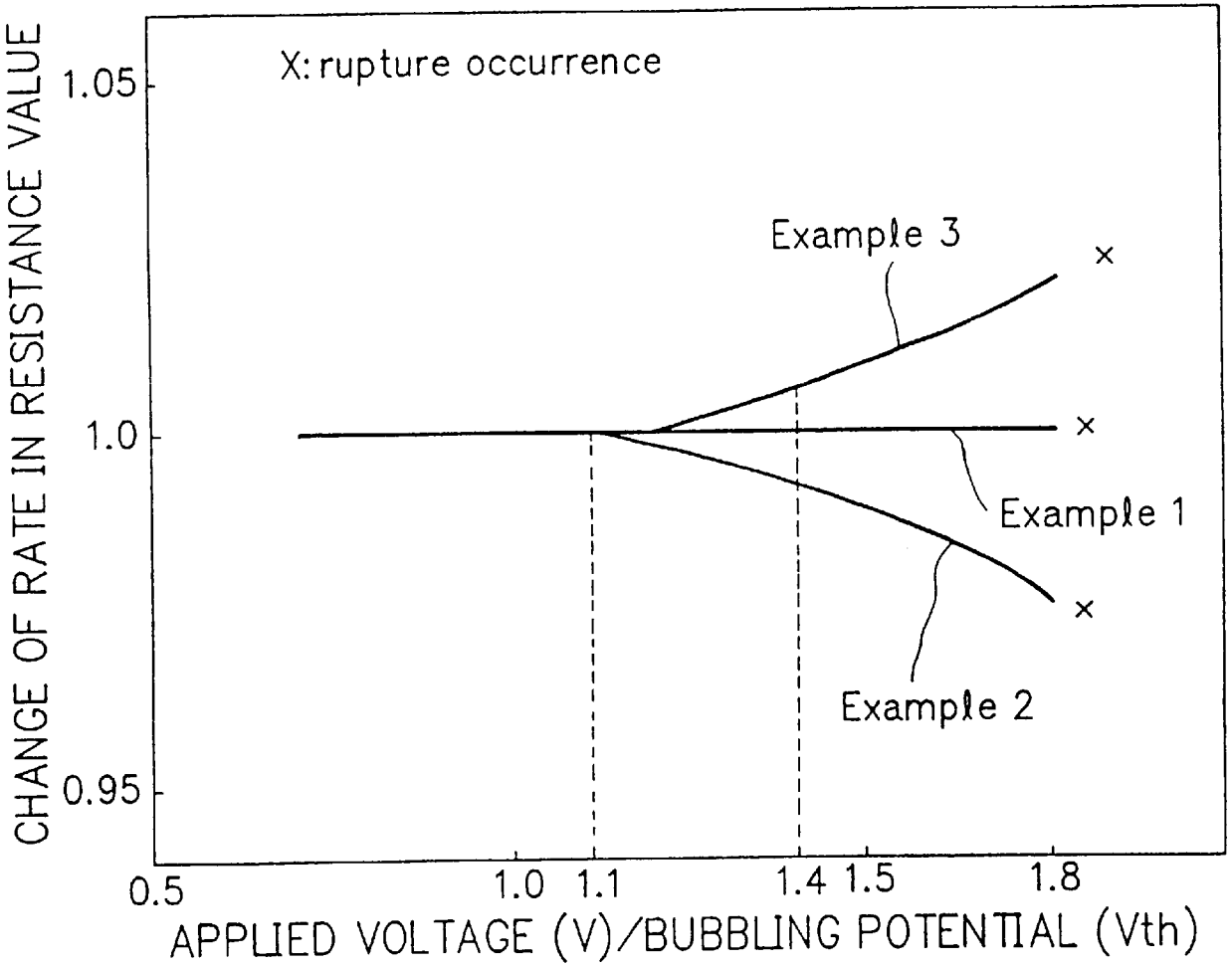
FIG. 9 shows a graph illustrating the results of the SST tests in examples belonging to the present invention, which will be later described.

The evaluated results of the SST Test for each of the liquid jet heads obtained in Examples 1 to 3 are graphically shown in FIG. 9.

As for the evaluated results of the SST Test for each of the liquid jet heads obtained in Example 4 to 7, they were similar to those of the liquid jet head obtained in Example 1.

Based on the evaluated results of the SST Test, any of the heat generating resistor layers of the liquid jet heads obtained in Examples 1 to 7 was found to be excellent one that is hardly deteriorated in terms of the resistance value. Particularly, as apparent from FIG. 9, it is understood that any of the heat generating resistor layers of the liquid jet heads obtained in Examples 1 to 3 is of 1.8 $V_{th}$ in terms of the breakdown voltage ratio $K_b$ and thus, excels in the heat generating performance.

The CST Test was conducted in the following manner. That is, a pulse signal of 7 μsec was applied to the ink jet head to obtained a threshold voltage $V_{th}$ for commencing discharging of ink. Thereafter, a pulse was continuously applied under condition of 2 kHz while fixing the driving voltage at 1.3 $V_{th}$ and without using ink, until the number of the pulse applied reached to more than $1\times10^9$, whereby the heat pulse durability of the heat generating resistor layer of the ink jet head was observed. The evaluated results obtained are graphically shown in FIG. 10.

The PD Test was conducted for the purpose of evaluating the number of printing sheets which can be continuously printed by the ink jet head without the heat generating resistor being deteriorated in terms of the resistance value, specifically, without occurrence of a rupture (or breakdown) at the heat generating resistor.

Now, in general, as for the resistance of the heat generating resistor in an ink jet head, there is a tendency that it is increased as the number of characters printed is increased to thereby reduce the electric current flown into the heat generating resistor layer wherein the heat generating resistor layer is maintained in a workable state. However, in this case, because the electric current flown into the heat generating resistor layer is decreased, the quantity of a thermal energy generated by the heat generating resistor layer is decreased to cause a reduction in the quantity of ink discharged, resulting in providing an printed image which is poor in image density.

The PD Test was conducted in the following manner.

That is, a pulse signal of 7 μsec was applied to the ink jet head to obtained a threshold voltage $V_{th}$ for commencing discharging of ink. Thereafter, printing was continuously conducted under conditions of 1.3 $V_{th}$ for the driving voltage and 2 kHz for the driving frequency, wherein a print test pattern containing 1,500 characters was continuously printed a number of A4-sized papers, whereby the number of A4-sized papers for which printing could be conducted without occurrence of a rupture (or breakdown) at the heat generating resistor layer was observed. The evaluated results obtained are collectively shown in Table 3, and they are graphically shown in FIG. 11.

Figure 10:
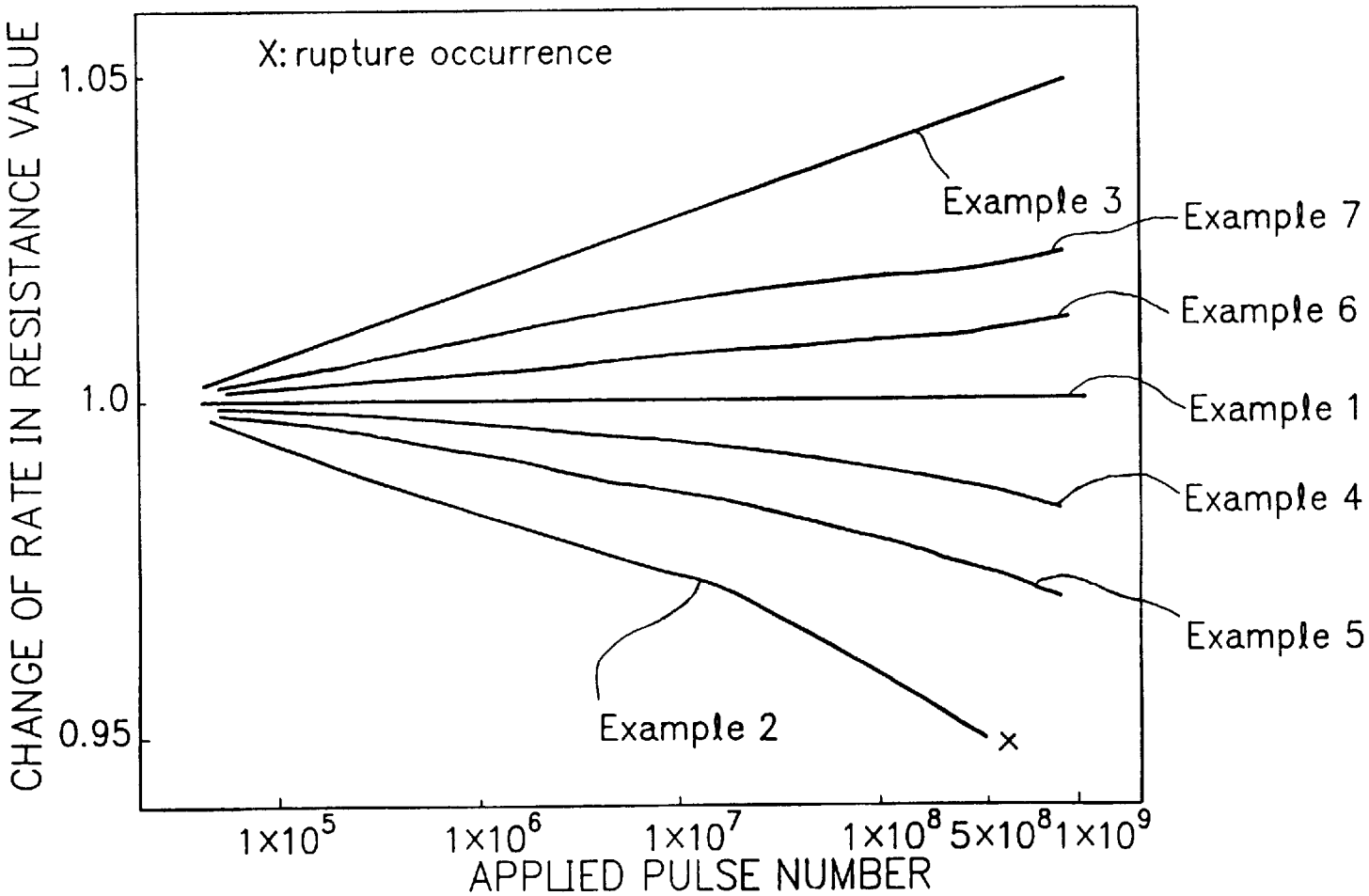
FIG. 10 shows a graph illustrating the results of the CST tests in examples belonging to the present invention, which will be later described.
Figure 11:
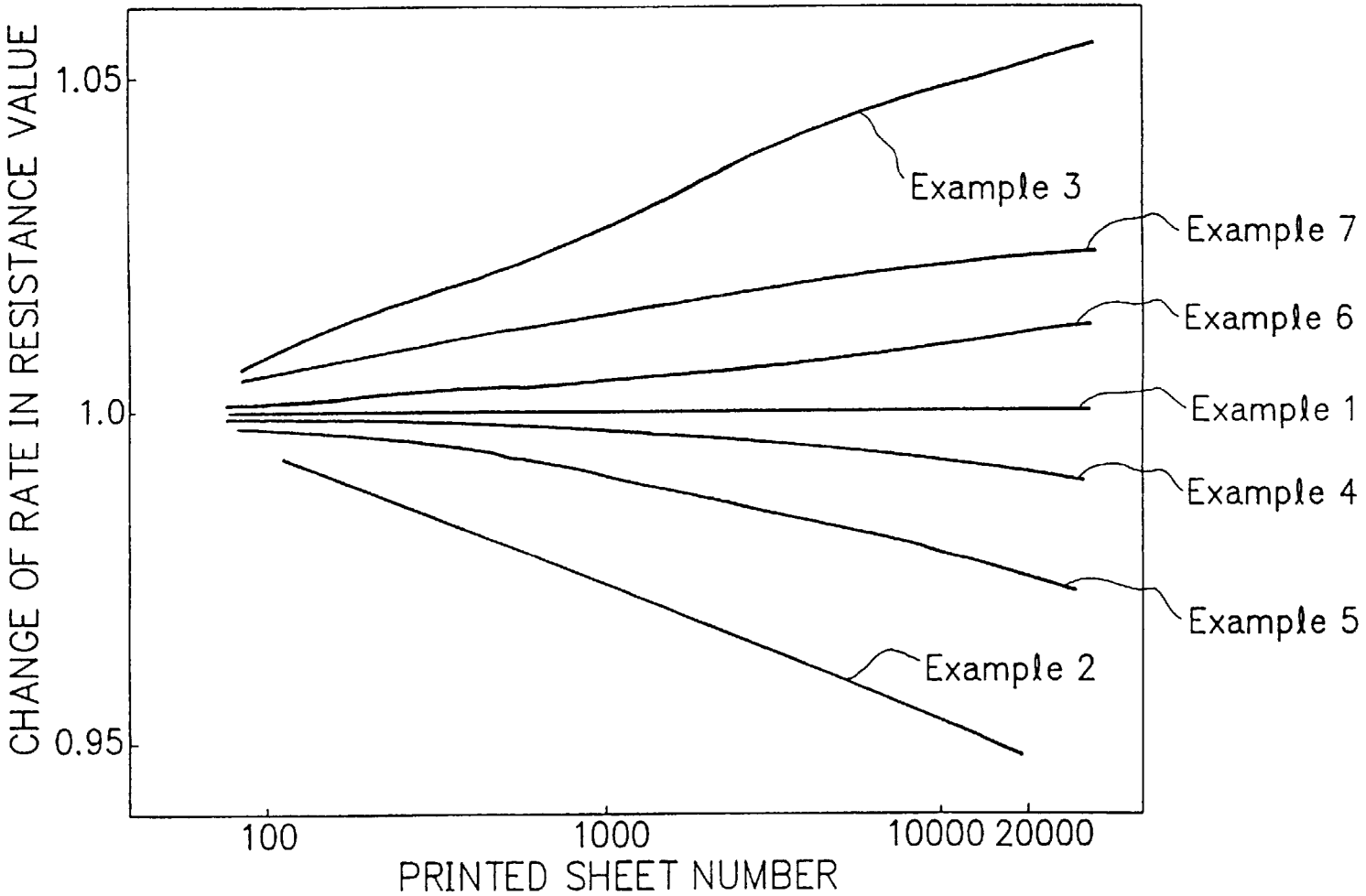
FIG. 11 s hows a graph illustrating the results of the durability tests in examples belonging to the present invention, which will be later described.

Based on the evaluated results shown in FIGS. 10 and 11 and Table 3, there were obtained the following facts.

That is, the ink jet head obtained in Example 1 is the most excellent among others. Specifically, the heat generating resistor layer of the ink jet head obtained in Example 1 is maintained in a stable state without causing a change in the resistance value even upon repeated use over a long period of time wherein a great many pulses are applied and it enables to continuously print a high quality image on more than 20,000 printing sheets without the heat generating resistor layer being deteriorated in terms of the heat generating performance. Herein, as for the number of the pulses applied for printing 1500 characters on a A4-sized paper, it is about $3\times10^4$. Hence, the number of the pulses applied for continuously printing 1500 characters on each of 20,000 A4-sized papers reaches $5\times10^8$ to $6\times10^8$. In view of this, it is understood that the ink jet head obtained in Example 1 still enables to conduct desirable printing even after such great many pulses having been applied, wherein the heat generating layer is still maintained in a stable state without being deteriorated in terms of the heat generating performance.

Thus, it is understood that the ink jet head obtained in Example 1 excels in durability and also in discharging characteristics and it stably and continuously provides an extremely high quality printed image over a long period of time without being deteriorated in terms of the ink discharging performance.

In the case of the ink jet head obtained in Example 2, the heat generating resistor layer thereof is relatively inferior that of the ink jet head obtained in Example 1, wherein the resistance value thereof is liable to be decreased when a great many pulses are applied (see, FIG. 10). However, as apparent from FIG. 11 and Table 3, it is understood the ink jet head obtained in Example 2 enables to continuously print a high quality image on 20,000 printing sheets without the heat generating resistor layer being deteriorated in terms of the heat generating performance.

In the case of the ink jet head obtained in Example 3, the heat generating resistor layer thereof is relatively inferior to that of the ink jet head obtained in Example 1, wherein the resistance value thereof is liable to be increased when a great many pulses are applied (see, FIG. 10). However, as apparent from FIG. 11 and Table 3, it is understood the ink jet head obtained in Example 2 enables to continuously print a high quality image on 20,000 printing sheets without the heat generating resistor layer being deteriorated in terms of the heat generating performance.

As for the ink jet heads obtained in Examples 4 to 7, it is understood that they are similar to the ink jet head obtained in Example 1. Particularly, they enable to conduct desirable printing even after a great many pulses having been applied, wherein their heat generating layer is still maintained in a stable state without being deteriorated in terms of the heat generating performance.

Thus, it is understood that any of the ink jet heads obtained in Examples 4 to 7 excels in durability and also in discharging characteristics and it stably and continuously provides a high quality printed image over a long period of time without being deteriorated in terms of the ink discharging performance.

There were obtained further facts. That is, a film substantially composed of $TaN_{0.8hex}$ only is the most appropriated as a heat generating resistor layer for use in an ink jet head. The use of a heat generating resistor layer formed of the film substantially composed of $TaN_{0.8hex}$ only provides an extremely highly reliable ink jet head.

Any of other tantalum nitride films composed of $TaN_{0.8hex}$ in a content ratio of more than 17 mol. % and $Ta_2N_{hex}$ in a content ratio of more than 20 mol. % also enables to provide a highly reliable heat generating resistor layer for use in an ink jet head, and the use of any of these heat generating resistor layer provides a highly reliable ink jet head.

Further, any of other tantalum nitride films composed of $TaN_{0.8hex}$ in a content ratio of more than 20 mol. % and $TaN_{hex}$ in a content ratio of more than 20 mol. % also enables to provide a highly reliable heat generating resistor layer for use in an ink jet head, and the use of any of these heat generating resistor layer provides a highly reliable ink jet head.

In the above described examples, the thickness of the heat generating resistor layer was made to be 1000 Å.

The present inventors prepared a plurality of ink jet heads wherein their heat generating resistor layer was made to be of a thickness in the range of 200 to 500 Å. Each of the ink jet heads was evaluated by the foregoing SST Test, CST Test, and PD Test. As a result, satisfactory results similar to those obtained in the above described examples were obtained for any of these ink jet heads.

TABLE 1

| Head Sample No. | 1 | 2 | 3 | 4 | 5 |
|---|---|---|---|---|---|
| breakdown voltage ratio $K_b$ | 1.8 | 1.8 | 1.8 | 1.7 | 1.7 |

TABLE 2

| | chemical composition ratio x of $Ta_xN$ | | | | | | |
|---|---|---|---|---|---|---|---|
| crystal | 1.85 | 1.625 | 1.4 | 1.25 | 1.2 | 1.125 | 1.05 |
| $TaN_{0.8hex}$ (mol. %) | 17 | 50 | 80 | 100 | 80 | 50 | 20 |
| $Ta_2N_{hex}$ (mol. %) | 83 | 50 | 20 | | | | |
| $TaN_{hex}$ (mol.) | | | | | 20 | 50 | 80 |
| Example | 2 | 5 | 4 | 1 | 6 | 7 | 3 |

TABLE 3

| | crystal composition | number of printing sheets which can be printed | printed image quality: after 10000 sheets printed | after 20000 sheets printed | the reason why defective printing occurred |
|---|---|---|---|---|---|
| Example 1 | $TaN_{0.8}$ | over 20000 sheets | ○ | ○ | |
| Example 2 | $TaN_{0.8}$ + $Ta_2N$ | 20000 sheets | ○ | X | non-discharging due to occurrence of a rapture at the heat generating resistor layer |
| Example 3 | $TaN_{0.8}$ + TaN | over 20000 sheets | ○ | Δ | relatively poor in density |
| Example 4 | $TaN_{0.8}$ + $Ta_2N$ | over 20000 sheets | ○ | ○ | |
| Example 5 | $TaN_{0.8}$ + $Ta_2N$ | over 20000 sheets | ○ | ○ | |
| Example 6 | $TaN_{0.8}$ + TaN | over 20000 sheets | ○ | ○ | |
| Example 7 | $TaN_{0.8}$ + TaN | over 20000 sheets | ○ | ○ | |

What is claimed is:

1. A substrate for a liquid jet head comprising a support member and an electrothermal converting body disposed above said support member, said electrothermal converting body including a heat generating resistor layer for generating thermal energy and electrodes being electrically connected to said heat generating resistor layer for supplying an electric signal to generate said thermal energy in said heat generating resistor layer, characterized in that said heat generating resistor layer comprises a film composed of a $TaN_{0.8hex}$-containing tantalum nitride material, with hex being a hexagonal structure.

2. A substrate for a liquid jet head according to claim , wherein the $TaN_{0.8hex}$-containing tantalum nitride material is selected from the group consisting of a tantalum nitride material substantially comprising $TaN_{0.8hex}$, tantalum nitride materials containing $TaN_{0.8hex}$ in an amount of more than 17 mol. %, tantalum nitride materials containing $TaN_{0.8hex}$, and $Ta_2N$, and tantalum nitride materials containing $TaN_{0.8hex}$ and TaN.

3. A substrate for a liquid jet head according to claim 1, wherein the heat generating resistor layer is a multi-layered structure having a layer comprising the film composed of the $TaN_{0.8hex}$-containing tantalum nitride material.

4. A substrate for a liquid jet head according to claim 1 which is a multi-layered structure including the heat generating resistor layer.

5. A substrate for a liquid jet head according to claim 4, wherein the multi-layered structure further includes a heat accumulating layer, a protective layer, and a cavitation preventive layer.

6. A liquid jet head comprising a liquid discharging outlet; a substrate for a liquid jet head including a support member and an electrothermal converting body disposed above said support member, said electrothermal converting body including a heat generating resistor layer for generating thermal energy for discharging printing liquid from said discharging outlet and electrodes being electrically connected to said heat generating resistor layer for supplying an electric signal to generate said thermal energy in said heat generating resistor layer; and a liquid supplying pathway aligned with said electrothermal converting body of said substrate, characterized in that said heat generating resistor layer of said substrate comprises a film composed of a $TaN_{0.8hex}$-containing tantalum nitride material, with hex being a hexagonal structure.

7. A liquid jet head according to claim 6, wherein the $TaN_{0.8hex}$-containing tantalum nitride material is selected from the group consisting of a tantalum nitride material substantially comprising $TaN_{0.8hex}$, tantalum nitride materials containing $TaN_{0.8hex}$ in an amount of more than 17 mol. %, tantalum nitride materials containing $TaN_{0.8hex}$ and $Ta_2N$, and tantalum nitride materials containing $TaN_{0.8hex}$ and TaN.

8. A liquid jet head according to claim 6, wherein the heat generating resistor layer is a multi-layered structure having a layer comprising the film composed of the $TaN_{0.8hex}$-containing tantalum nitride material.

9. A liquid jet head according to claim 6, wherein the substrate is a multi-layered structure including the heat generating resistor layer.

10. A liquid jet head according to claim 9, wherein the multi-layered structure further includes a heat accumulating layer, a protective layer, and a cavitation preventive layer.

11. A liquid jet apparatus comprising (a) a liquid jet head including a liquid discharging outlet; a substrate for a liquid jet head, including a support member and an electrothermal converting body disposed above said support member, said electrothermal converting body including a heat generating resistor layer for generating thermal energy for discharging printing liquid from said discharging outlet and electrodes being electrically connected to said heat generating resistor layer for supplying an electric signal to generate said thermal energy in said heat generating resistor layer; and a liquid supplying pathway aligned with said electrothermal converting body of said substrate, and (b) an electric signal supplying means for supplying said electric signal to said heat generating resistor layer of said substrate, characterized in that said heat generating resistor layer of said substrate comprises a film composed of a $TaN_{0.8hex}$-containing tantalum nitride material, with hex being a hexagonal structure.

12. A liquid jet apparatus according to claim 11, wherein the $TaN_{0.8hex}$-containing tantalum nitride material is selected from the group consisting of a tantalum nitride material substantially comprising $TaN_{0.8hex}$ tantalum nitride materials containing $TaN_{0.8hex}$ in an amount of more than 17 mol. %, tantalum nitride materials containing $TaN_{0.8hex}$ and $Ta_2N$, and tantalum nitride materials containing $TaN_{0.8hex}$ and TaN.

13. A liquid jet apparatus according to claim 11, wherein the heat generating resistor layer is a multi-layered structure having a layer comprising the film composed of the $TaN_{08\ hex}$-containing tantalum nitride material.

14. A liquid jet apparatus according to claim 11, wherein the substrate has a multi-layered structure including the heat generating resistor layer.

15. A liquid jet apparatus according to claim 14, wherein the multi-layered structure further includes a heat accumulating layer, a protective layer, and a cavitation preventive layer.

* * * * *

UNITED STATES PATENT AND TRADEMARK OFFICE

CERTIFICATE OF CORRECTION

PATENT NO. : 6,375,312 B1
DATED : April 23, 2002
INVENTOR(S) : Masami Ikeda et al.

It is certified that error appears in the above-identified patent and that said Letters Patent is hereby corrected as shown below:

Title page, Item [54] and Column 1, line 2,
Title, "$TAN_{0.8}$," should read -- $TaN_{0.8}$, --.

Column 1,
Line 65, "droplet whereby" should read -- droplet, thereby --.

Column 2,
Line 1, "cased" should read -- caused --;
Line 4, "a" should read -- an --; and
Line 7, "droplet whereby" should read -- droplet, thereby --.

Column 3,
Line 35, "an markedly" should read -- a markedly --.

Column 4,
Line 31, "meets" should read -- meet --.

Column 9,
Line 32, "prises" should read -- prise --.

Column 11,
Line 5, "such" should read -- of such --.

Column 12,
Lines 6 and 47, "there" should read -- their --; and
Line 22, "deteriorate" should read -- deteriorated --.

Column 13,
Line 18, "make" should read -- makes --.

Column 14,
Line 39, "resistor whereby determine" should read -- resistor, thereby determining --.

Column 16,
Line 8, "member" should read -- members --;
Line 40, "results," should read -- result, --;
Line 53, "350 to about 360 in value of 20" should read -- $35^{\circ}$ to about $36^{\circ}$ in value of $2\theta$ --;

UNITED STATES PATENT AND TRADEMARK OFFICE

CERTIFICATE OF CORRECTION

PATENT NO. : 6,375,312 B1
DATED : April 23, 2002
INVENTOR(S) : Masami Ikeda et al.

It is certified that error appears in the above-identified patent and that said Letters Patent is hereby corrected as shown below:

Column 16 (cont'd),
Line 55, "20." should read -- 2θ. --;
Line 60, "Xray" should read -- X-ray --; and
Line 63, "analyzed-results" should read -- analyzed results --.

Column 17,
Line 37, "usec to several tens usec." should read -- μsec to several tens of μsec. --.

Column 18,
Line 1, "was" should be deleted;
Line 3, "was occurred" should read -- occurred --;
Line 53, "rapture" should read -- rupture --; and
Line 54, "rapture" should read -- a rupture --.

Column 19,
Line 40, "at ink" should read -- of ink --.

Column 20,
Line 27, "is occurred" should read -- occurs --; and
Line 38, "a state that" should read -- in such a state that --.

Column 21,
Line 2, "be" should be deleted; and
Line 66, "Mm" shoud read -- μm --.

Column 22,
Line 21, "Mm" should read -- μm --.
Line 37, "was" should read deleted.

Column 23,
Lines 43 and 47, "extend," should read -- extent, --.

Column 24,
Line 4, "dedicating" should read -- being dedicated --;
Line 14, "case a somewhat difference" should read -- causes some --;
Line 25, "suffered from a damage," should read -- damaged, --;
Line 30, "becomes to be of" should read -- comes to have --;

UNITED STATES PATENT AND TRADEMARK OFFICE

CERTIFICATE OF CORRECTION

PATENT NO. : 6,375,312 B1
DATED : April 23, 2002
INVENTOR(S) : Masami Ikeda et al.

It is certified that error appears in the above-identified patent and that said Letters Patent is hereby corrected as shown below:

Column 24 (cont'd),
Line 33, "attain" should read -- to attain --;
Line 39, "used" should read -- be used --; and
Line 66, "were repeated" should be deleted.

Column 25,
Line 7, "contains" should read -- contain --.

Column 26,
Lines 9, 40 and 54, "X" should read -- x --; and
Line 10, "a" should read -- an --.

Column 27,
Lines 2 and 16, "X" should read -- x --.

Column 28,
Line 5, "flown" shown read -- flowing --;
Line 9, "an" should read -- a --;
Line 18, "a" should read -- on a --;
Line 42, "having" should read -- have --; and
Line 53, "that" should read -- to that --.

Column 29,
Line 8, "having" should read -- have --;
Line 20, "appropriated" should read -- appropriate --;
Line 37, "layer" should read -- layers --; and
Table 2, "$TaN_{hex}$ (mol.)" should read -- $TaN_{hex}$ (mol.%) --.

Column 30,
Table 3, "rapture" should read -- rupture --;
Line 41, "claim ," should read -- claim 1, --; and
Line 46, "$TaN_{0.8hex}$, and" should read -- $TaN_{0.8hex}$ and --.

UNITED STATES PATENT AND TRADEMARK OFFICE

CERTIFICATE OF CORRECTION

PATENT NO. : 6,375,312 B1
DATED : April 23, 2002
INVENTOR(S) : Masami Ikeda et al.

It is certified that error appears in the above-identified patent and that said Letters Patent is hereby corrected as shown below:

Column 32,
Line 21, "$TaN_{0.8\ hex}$-containing" should read -- $TaN_{0.8hex}$-containing --.

Signed and Sealed this

Fifth Day of August, 2003

JAMES E. ROGAN
*Director of the United States Patent and Trademark Office*